US009847067B2

(12) United States Patent
Li et al.

(10) Patent No.: US 9,847,067 B2
(45) Date of Patent: Dec. 19, 2017

(54) SHIFT REGISTER, GATE DRIVING CIRCUIT, DISPLAY PANEL, DRIVING METHOD THEREOF AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Fuqiang Li, Beijing (CN); Jun Fan, Beijing (CN); Xiaochuan Chen, Beijing (CN); Xue Dong, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 15/118,303

(22) PCT Filed: Dec. 29, 2015

(86) PCT No.: PCT/CN2015/099334

§ 371 (c)(1),
(2) Date: Aug. 11, 2016

(87) PCT Pub. No.: WO2017/020517

PCT Pub. Date: Feb. 9, 2017

(65) Prior Publication Data

US 2017/0178582 A1 Jun. 22, 2017

(30) Foreign Application Priority Data

Aug. 6, 2015 (CN) ..... 2015 1 0477072

(51) Int. Cl.
*G09G 3/36* (2006.01)

(52) U.S. Cl.
CPC ..... *G09G 3/3659* (2013.01); *G09G 3/3607* (2013.01); *G09G 3/3677* (2013.01);
(Continued)

(58) Field of Classification Search
None
See application file for complete search history.

(56) References Cited

U.S. PATENT DOCUMENTS

2011/0228893 A1* 9/2011 Tobita ..... G11C 19/184 377/77
2015/0318052 A1* 11/2015 Li ..... G11C 19/28 377/64

FOREIGN PATENT DOCUMENTS

CN 102800289 A 11/2012
CN 102819998 A 12/2012
(Continued)

OTHER PUBLICATIONS

International Search Report and Written Opinion dated Apr. 27, 2016; PCT/CN2015/099334.

*Primary Examiner* — Nicholas Lee
(74) *Attorney, Agent, or Firm* — Ladas & Parry LLP

(57) ABSTRACT

A shift register, a driving method of a display panel and related device. The shift register adds a selection output unit and a selection control signal terminal to the current shift register; the output terminal of the selection output unit outputs a signal that is same as the signal of the driving signal output terminal when the selection control signal terminal receives a selection control signal. Then whether there is a scan signal outputted from the selection driving output terminal is determined by the control of the selection control signal terminal and the selection output unit. Further, in using the gate-driving circuit consisting of the above shift register, selectively outputting scan signal to certain gate lines can be achieved. Further, in using said gate driving
(Continued)

circuit in the display panel of the present disclosure, arranging three neighboring gate lines as a set of gate line along scanning direction and each set of gate line receiving scan signal sequentially along the scanning direction may be realized.

17 Claims, 17 Drawing Sheets

(52) U.S. Cl.
CPC ..... *G09G 2300/0426* (2013.01); *G09G 2310/0213* (2013.01); *G09G 2310/0272* (2013.01); *G09G 2310/0289* (2013.01); *G09G 2310/08* (2013.01)

(56) References Cited

FOREIGN PATENT DOCUMENTS

| | | | |
|---|---|---|---|
| CN | 104700805 | A | 6/2015 |
| CN | 104966506 | A | 10/2015 |
| CN | 104978943 | A | 10/2015 |

* cited by examiner

SHIFT REGISTER, GATE DRIVING CIRCUIT, DISPLAY PANEL, DRIVING METHOD THEREOF AND DISPLAY DEVICE

TECHNICAL FIELD

The present disclosure relates to the display technical field, and in particular to a shift register, gate driving circuit, display panel, driving method thereof and a display device.

BACKGROUND

In the era of technological advancement, the liquid crystal display has been widely used to electronic display devices, such as television, computer, cell phone, personal digital assistant, etc. The liquid crystal display comprises source driver, gate driver, liquid crystal display panel, etc. The liquid crystal display panel includes pixel array; and the gate driver is used for sequentially turning on the corresponding pixel lines in the pixel array so as to transmit pixel data outputted by the source driver to the pixel, thereby to display an image to be displayed.

At present, the gate driver is generally formed on the array substrate of the liquid crystal display by array process, that is, the gate driver on array (GOA) process. This integrated process not only saves cost, but also can do beautiful design for bilaterally symmetrical liquid crystal panel; at the same time; this process saves the wiring space of the bonding area of the gate Integrated Circuit and the Fan-out area, thereby realizing a narrow border design; and this integrated process saves the Bonding process in the direction of the gate scanning line as well thus promoting the capability of producing and defect rate.

The gate driver usually consists of a plurality of shift registers in a cascade connection, and it lets the driving signal output terminal of each of the shift register correspond to a gate line separately so as to output scanning signals to all gate lines sequentially along the scanning direction. Structure of the specific shift register is shown in FIG. 1, comprising: an input unit 1, a reset unit 2, a node control unit 3, a pull-up unit 4, a pull-down unit 5, an input signal terminal Input, a reset signal terminal Reset, a first clock signal terminal ck and a reference signal terminal Vref. Wherein an output terminal of the input unit 1, an output terminal of the reset unit 2, a first terminal of the node control unit 3 and a control terminal of the pull-up unit 4 are all connected to a first node PU; both a second terminal of the node control unit 3 and a control terminal of the pull-down unit 5 are connected to a second node PD; both an output terminal of the pull-up unit 4 and an output terminal of the pull-down unit 5 are connected to a driving signal output terminal Out shifted on the register; the input unit 1 is configured to control the potential of the first node PU under the control of the input signal terminal Input, the reset unit 2 is configured to control the potential of the first node PU under the control of the reset signal terminal Reset, the node control unit 3 is configured to control the potential of the first node PU and the second node PD, the pull-up unit 4 is configured to provide signal of a first clock signal terminal CK for the driving signal output terminal Out under the control of the first node PU, and the pull-down unit 5 is configured to provide signal of a reference signal terminal Vref for the driving signal output terminal Out under the control of the second node PD.

At present, the shift register in the gate driver of the display panel is generally as shown in FIG. 1, the display panel outputs scanning signal to each gate line sequentially through the shift register of each stage along the scanning direction. However, with the higher resolution rate of display products, the power consumption of the display panel is increasing, which leads to great reduction of the standby time. Therefore, how to reduce the power consumption of display products to increase standby time is the technical problem that have to be solved by those skilled in the art.

SUMMARY

Further aspects and advantages of the present disclosure will be set forth in the following description, and parts of them are evident in the description or may be obtained in the practice of the present disclosure.

Accordingly, embodiments of the present disclosure provide a shift register, a driving method of the display panel and related devices, which are used to reduce the resolution rate of the display panel and finally reduce the power consumption of the display panel under specific conditions.

The embodiments of the present disclosure provide a shift register, comprising: an input unit, a reset unit, a node control unit, a pull-up unit, a pull-down unit, an input signal terminal, a reset signal terminal, a first clock signal terminal and a reference signal terminal, wherein an output terminal of the input unit, an output terminal of the reset unit, a first terminal of the node control unit and a control terminal of the pull-up unit are all connected to a first node, and both a second terminal of the node control unit and a control terminal of the pull-down unit are connected to a second node; both an output terminal of the pull-up unit and an output terminal of the pull-down unit are connected to a driving signal output terminal shifted in the register; the input unit is configured to control the potential of the first node under the control of the input signal terminal, the reset unit is configured to control the potential of the first node under the control of the reset signal terminal, the node control unit is configured to control the potential of the first node and the second node, the pull-up unit is configured to provide signal of a first clock signal terminal for the driving signal output terminal under the control of the first node, and the pull-down unit is configured to provide signal of a reference signal terminal for the driving signal output terminal under the control of the second node; further comprising: a selection output unit and a selection control signal terminal; wherein a first input terminal of the selection output unit is connected to the first node, a second input terminal is connected to the second node, a third input terminal is connected to a selection control signal terminal, and an output terminal is used as selection driving output terminal of the shift register;

the selection output unit uses its output terminal to output signal that is same as signal of the driving signal, output terminal of the shift register when the selection control signal terminal receives selection control signal.

In a possible mode of carrying out the invention, the shift register provided by the present embodiment comprises the selection output unit, which includes: the first switching transistor, the second switching transistor, the third switching transistor and the fourth switching transistor; wherein the first switching transistor, the gate thereof is connected to the gate of the second switching transistor and the selection control signal terminal, the source thereof is connected to the first node and the drain thereof is connected to the gate of the third switching transistor;

the second switching transistor, the source thereof is connected to the second node and the drain thereof is connected to the gate of the fourth switching transistor;

the third switching transistor, the source thereof is connected to the first dock signal terminal and the drain thereof is connected to the selection driving output terminal;

the fourth switching transistor, the source thereof is connected to reference signal terminal and the drain thereof is connected to the selection driving output terminal;

For example, in the shift register provided by embodiments of the present disclosure, the first switching transistor and the second switching transistor are both P-type transistor or Ni-type transistor;

the third switching transistor and the fourth switching transistor are both P-type transistor or N-type transistor.

Accordingly, the embodiments of the present disclosure further provide a gate driving circuit Which includes a plurality of any above-described shift registers in cascade provided by the embodiments of the present disclosure; wherein except for a shift register at last stage, driving signal output terminal of each of the rest shift register is connected to input signal terminal of its adjacent shift register at a next stage, correspondingly;

signal input terminal of a shift register at the first stage is configured to receive trigger signal;

except for the shift register at the first stage, driving signal output terminal of each of the rest shift register is connected to reset signal terminal of its adjacent shift register at a previous stage; correspondingly;

selection driving output terminal of each of the shift register is configured to connect to a gate line.

Correspondingly, embodiments of the present invention further provide a display panel, which comprises: 4N gate lines, a first gate driving circuit and a third gate driving circuit located on one side of the display panel, and a second gate driving circuit and a fourth gate driving circuit located on the other side of the display panel; and all the first gate driving circuit, the second gate driving circuit, the third gate driving circuit and the fourth gate driving circuit are the gate driving circuit provided by the embodiments of the present invention;

Wherein selection driving output terminals of each of the shift register in the first gate driving circuit are connected to the (4n+1)th gate lines respectively, selection driving output terminals of each of the shift register in the second gate driving circuit are connected to the (4n+2)th gate lines respectively, selection driving output terminals of each of the shift register in the third gate driving circuit are connected to the (4n+3)th gate lines respectively, selection driving output terminals of each of the shift register in the fourth gate driving circuit are connected to the (4n+4)th gate lines respectively, wherein n is an integer larger than and equal to 0 but smaller than N;

the display panel further comprises: a driving control circuit, connected to each of the gate driving circuits, is at least configured to output selection control signal to each of the gate driving circuit, output a first set of time sequence control signal to the first gate driving circuit, output a second set of time sequence control signal to the second gate driving circuit, output a third set of time sequence control signal to the third gate driving circuit, and output a fourth set of time sequence control signal to the fourth gate driving circuit Wherein each set of time sequence control signal at least includes trigger signal and clock signal, the width of the trigger signal in each set of time sequence control signal is same, and each of the gate driving circuit is configured to let the driving signal output terminal output scanning signal sequentially under the control of its corresponding set of the received time sequence control signal.

For example, the display panel provided by embodiments of the present disclosure further comprises: a mode switching circuit connected to the driving control circuit; for each value of in; switching devices that are connected between the (3m+1)th gate line and (3m+2)th gate line, respectively; for each value of m, switching devices that are connected between the (3m+2)th gate line and (3m+3)th gate line, respectively; each of the switching devices is connected to the mode switching circuit; wherein m is an integer larger than and equal to 0; in receiving a first mode control signal; the mode switching circuit is configured to:

control all the switching devices in the ON state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; delay timing of each of signal in the fourth set of time sequence control signal for one-half of the width of the trigger signal than timing of the corresponding signal in the third set of time sequence control signal;

and control the driving control circuit to output the selection control signal towards the selection control signal terminal of the shift register connected to the (3m+1)th gate line, or control the driving control circuit to output the selection control signal towards the selection control signal terminal of the shift register connected to the (3m+2)th gate line, or control the driving control circuit to output the selection control signal towards the selection control signal terminal of the shift register connected to the (3m±3)th gate line.

For example, in the display panel provided by embodiments of the present disclosure, while receiving a second mode control signal, the mode switching circuit is also configured to:

control all the switching devices in the OFF state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; and delay timing of each of signal in the fourth set of time sequence control signal for one-half of the width of the trigger signal than timing of the corresponding signal in the third set of time sequence control signal;

and control all the driving control circuits to output selection control signal towards the selection control signal terminal of all the shift register, For example, in the display panel provided by embodiments of the present disclosure, while receiving a third mode control signal, the mode switching circuit is also configured to:

control all the switching devices in the OFF state;

make timing of each of signal in the first set of time sequence control signal same as timing of the corresponding signal in the second set of time sequence control signal; make timing of each of signal in the third set of time sequence control signal same as timing of the corresponding signal in the fourth set of time sequence control signal; and delay timing of each of signal in the third set of time sequence control signal for one width of trigger signal than timing of the corresponding signal in the first set of time sequence control signal;

and control all the driving control circuits to output selection control signal towards the selection control signal terminal of all the shift register, For example, in the display panel provided by embodiments of the present disclosure, while receiving a fourth mode control signal, the mode switching circuit is also configured to;

control all the switching devices in the OFF state;

make timing of each of signal in the first set of time sequence control signal same as timing of the corresponding signal in the second set of time sequence control signal; timing of the corresponding signal in the third set of time sequence control signal, timing of the corresponding signal in the fourth set of time sequence control signal;

and control all the driving control circuits to output selection control signal towards the selection control signal terminal of all the shift register.

Correspondingly, embodiments of the present disclosure provide a display device comprising any of the above display panel provided by embodiments of the present disclosure.

Correspondingly, embodiments of the present disclosure provide a driving method of the above display panel comprising:

in receiving a first mode control signal, the mode switching circuit controls all the switching devices in the ON state; delays timing of each of signal in the second set of time sequence control signal for one-half of the width of the trigger signal than timing of the corresponding signal in the first set of time sequence control signal; delays timing of each of signal in the third set of time sequence control signal for one-half of the width of the trigger signal than timing of the corresponding signal in the second set of time sequence control signal; delays timing of each of signal in the fourth set of time sequence control signal for one-half of the width of the trigger signal than timing of the corresponding signal in the third set of time sequence control signal; controls all the driving control circuits to output the selection control signal towards the selection control signal terminal of the shift register connected to the (3m+1)th gate line, or controls all the driving control circuits to output the selection control signal towards the selection control signal terminal of the shift register connected to the (3m+2)th gate line, or controls all the driving control circuits to output the selection control signal towards the selection control signal terminal of the shift register connected to the (3m+3)th gate line;

or, while receiving a second mode control signal, the mode switching circuit controls all the switching devices in the OFF state; delays timing of each of signal in the second set of time sequence control signal for one-half of the width of the trigger signal than timing of the corresponding signal in the first set of time sequence control signal; delays timing of each of signal in the third set of time sequence control signal for one-half of the width of the trigger signal than timing of the corresponding signal in the second set of time sequence control signal; delays timing of each of signal in the fourth set of time sequence control signal for one-half of the width of the trigger signal than timing of the corresponding signal in the third set of time sequence control signal; and controls all the driving control circuits to output selection control signal towards the selection control signal terminal of all the shift register;

or, while receiving a third mode control signal, the mode switching circuit controls all the switching devices in the OFF state; makes timing of each of signal in the first set of time sequence control signal same as timing of the corresponding signal in the second set of time sequence control signal; makes timing of each of signal in the third set of time sequence control signal same as timing of the corresponding signal in the fourth set of time sequence control signal; delays timing of each of signal in the third set of time sequence control signal for one width of trigger signal than timing of the corresponding signal in the first set of time sequence control signal; and controls all the driving control circuits to output selection control signal towards the selection control signal terminal of all the shift register.

or, while receiving a fourth mode control signal, the mode switching circuit controls all the switching devices in the OFF state; makes timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal; and controls all the driving control circuits to output selection control signal towards the selection control signal terminal of all the shift register.

Embodiments of the present disclosure provide the shift register, the driving method of the display panel and related devices. The shift register corresponds to the current shift register with added selection output unit and selection control signal terminal; the selection output unit uses its output terminal to output signal that is same as signal of the driving signal output terminal of the shift register when the selection control signal terminal receives selection control signal. Moreover, whether there is scan signal outputted front the selection driving output terminal is determined by the control of the selection control signal terminal and the selection output unit. Further, when gate-driving circuit consisting of the above shift register is used, selectively outputting scan signal to certain gate lines can be achieved. Further, in the display panel provided by embodiments of the present disclosure, the above gate-driving circuit is used, and switching devices connected to (3m+1)th gate lines and (3m+2)th gate lines respectively, switching devices connected to (3m+2)th gate lines and (3m+3)th gate lines respectively and mode switching circuits connected to the driving control circuit are added as well. Therefore, when the mode switching circuits receives the first mode control signal, arranging three neighbouring gate lines as a set of gate line along scanning direction and each set of gate line receiving scan signal sequentially along the scanning direction may be realized. The resolution of the display panel is reduced to a third of the resolution, this allows the display panel to reduce power consumption and extend the standby time.

BRIEF DESCRIPTION OF THE DRAWINGS

A detailed explanation of preferred embodiments of the present invention has been provided in connection with drawings, the above and other purpose, characteristics and advantages of the present disclosure would become more apparent; wherein the same reference labels refer to units with the same structure in which.

DETAILED DESCRIPTION OF THE EMBODIMENTS

Figure 1:
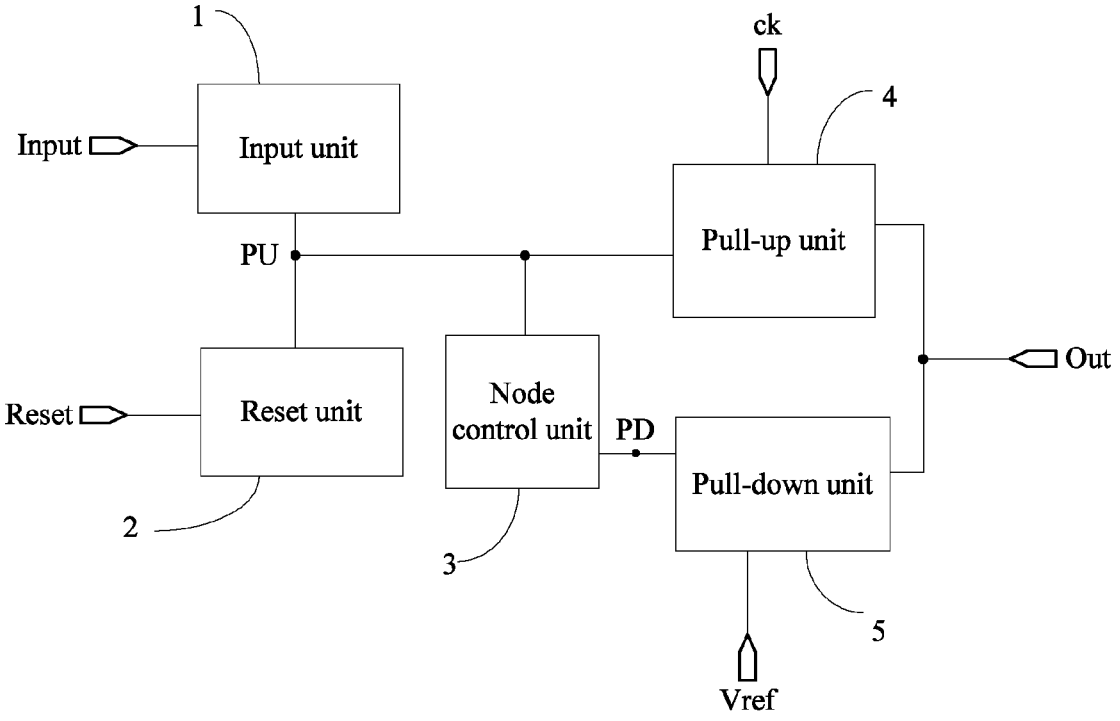
FIG. 1 is a schematic diagram of the structure of a well-known shift register.

The present disclosure will be described thoroughly below in reference to drawings of the embodiments of the present disclosure. However, the present disclosure can be implemented in many different forms and should not be limited to the embodiments of the present disclosure. On the contrary, these embodiments are provided to make the present disclosure become more thorough and complete, and these fully disclose the scope of the present disclosure for those skilled in the art. In the drawings, units are enlarged for clarity.

It should be understood that: each of elements, components and/or parts may be described by using terms the first, the second, the third and so on, but these elements, components and/or parts would not be limited by these terms. The function of these terms are only to distinguish these elements, components and/or parts. Therefore, the first element, component or part discussed subsequently may be named as the second element, component or part without departing from teachings of the present disclosure.

Unless otherwise defined, all terms (including technical and scientific terms) used herein have the same meaning of those skill in the art commonly understand. It should also be understood that: those terms defined in the ordinary dictionary should be interpreted as a meaning having consistent with their meaning in the context of related art, rather than an idealized or extreme formalized meaning, unless here make a clear definition.

In order to achieve a display panel that can reduce the power consumption, the gate driving circuit of the display panel provided by embodiments of the present disclosure uses a specially designed shift register. Below in connection with the accompanying drawings, shift registers, driving method of display panel and mode of carrying out the related device provided by embodiments of the present disclosure will be described in detail.

Figure 2:
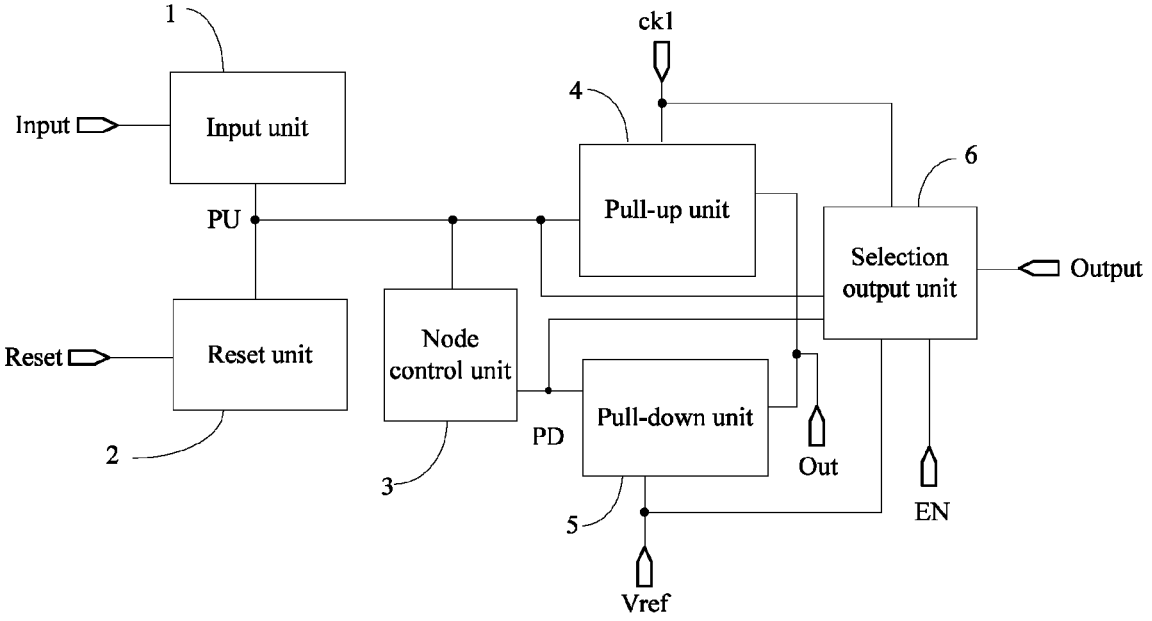
FIG. 2 is a schematic diagram of the structure of a shift register provided by the embodiment of the present disclosure.

The shift register provided by embodiments of the present disclosure will be described firstly as follows:

The embodiments of the present disclosure provide a shift register, as shown in FIG. 2, comprising: an input unit 1, a reset unit 2, a node control unit 3, a pull-up unit 4, a pull-down unit 5, an input signal terminal Input, a reset signal terminal Reset, a first clock signal terminal ck1 and a reference signal terminal Vref; wherein an output terminal of the input unit 1, an output terminal of the reset unit 2, the first terminal of the node control unit 3 and a control terminal of the pull-up unit 4 are all connected to the first node PU; the second terminal of the node control unit 3 and a control terminal of the pull-down unit 5 are both connected to the second node PD; an output terminal of the pull-up unit 4 and an output terminal of the pull-down unit 5 are both connected to a driving signal output terminal OUT shifted in the register; the input unit 1 is configured to control the potential of the first node under the control of the input signal terminal Input, the reset unit 2 is configured to control the potential of the first node PU under the control of the reset signal terminal Reset, the node control unit 3 is configured to control the potential of the first node A and the second node B, the pull-up unit 4 is configured to provide signal of the first clock signal terminal ck1 for the driving signal output terminal Out under the control of the first node PU, and the pull-down unit 5 is configured to provide signal of the reference signal terminal Vref for the driving signal output terminal Out under the control of the second node PD; further comprising: a selection output unit 6 and a selection control signal terminal EN; wherein the first input terminal of the selection output unit 6 is connected to the first node PU, the second input terminal is connected to the second node PD, the third input terminal is connected to a selection control signal terminal EN, and an output terminal is used as selection driving output terminal Out of the shift register;

the selection output unit 6 uses its output terminal to output signal which is same as signal outputted by the driving signal output terminal Out when the selection control signal is received by the selection control signal terminal EN.

The above shift register provided by embodiments of the present disclosure corresponds to current shift register with added selection output unit and selection control signal terminal; wherein the first input terminal of the selection output unit is connected to the first node, the second input terminal is connected the second node, the third input terminal is connected to the selection control signal terminal and the output terminal is connected to the selection driving output terminal of the shift register; the selection output unit uses its output terminal to output signal that is same as signal outputted by the driving signal output terminal of the shift register when the selection control signal terminal receives selection control signal. Moreover, whether there is scan signal outputted from the selection driving output terminal is determined by the control of the selection control signal terminal and the selection output unit. Further, in using gate-driving circuit consisting of the above shift register, selectively outputting scan signal to certain gate lines may be achieved.

In connection with the specific embodiment, the present disclosure will be described in detail. It should be noted that the present embodiment is to better explain the present disclosure but not to limit the present disclosure.

Figure 3:
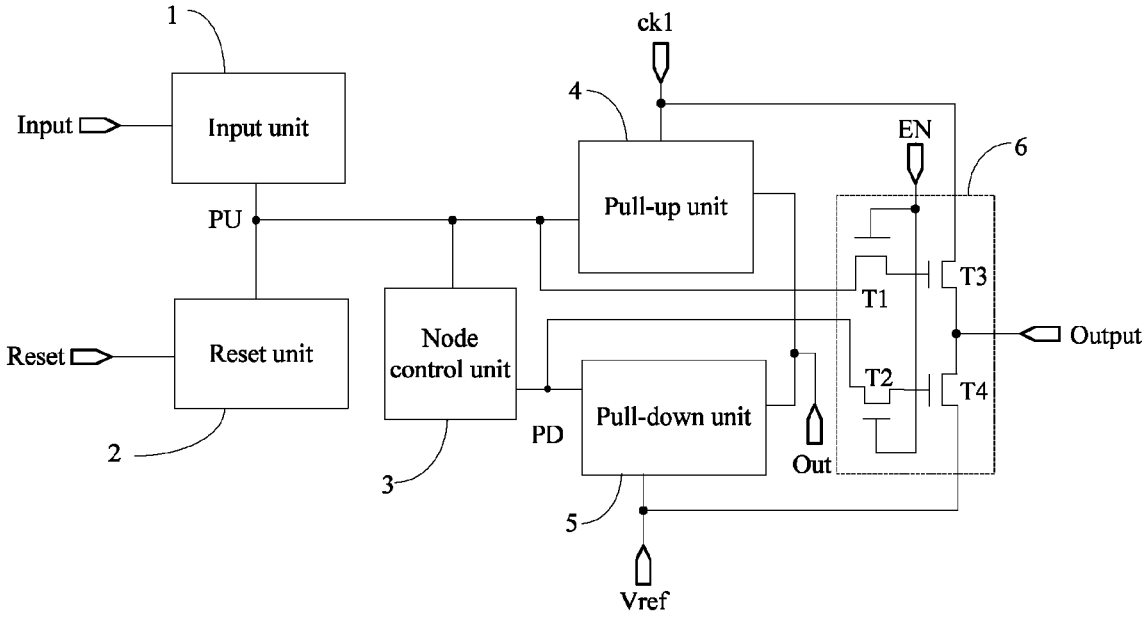
FIG. 3 is a schematic diagram of the specific structure of a selection output unit provided by the embodiment of the present disclosure.

For example, in the shift register provided by the embodiments of the present disclosure, as shown in FIG. 3, the selection output unit 6 includes: the first switching transistor T1, the second switching transistor 12, the third switching transistor 13 and the fourth switching transistor T4; wherein the first switching transistor T1, the gate thereof is connected to the gate of the second switching transistor T2 and the selection control signal terminal EN, the source thereof is connected to the first node PU and the drain thereof is connected to the gate of the third switching transistor T3;

the second switching transistor T2, the source thereof is connected to the second node PD and the drain thereof is connected to the gate of the fourth switching transistor T4;

the third swathing transistor T3, the source thereof is connected to the first clock signal terminal ck1 and the drain thereof is connected to the selection driving output terminal Output;

the fourth switching transistor T4, the source thereof is connected to reference signal terminal Vref and the drain thereof is connected to the selection driving output terminal Output.

In the specific embodiment, when the first switching transistor and the second switching transistor are in the ON state under the control of selection control signal terminal, the potential of the gate of the third switching transistor is same as that of the first node, the potential of the gate of the fourth switching transistor is same as that of the second node; when the pull-up unit provides, signal of the first clock signal terminal for the driving signal output terminal under the control of the first node, the third switching transistor would also provide signal of the first clock signal terminal for the selection driving output terminal; when the pull-down unit provides signal of the reference signal terminal for the driving signal output terminal under the control of the second node, the fourth switching transistor would also provide signal of the reference signal terminal for the selection driving output terminal so as to ensure that signal of the selection driving output terminal is same as that of the driving signal output terminal.

For example, in the above shift register provided by embodiments of the present disclosure, both of the first switching transistor and the second switching transistor are P-type transistor or N-type transistor;

the third switching transistor and the fourth switching transistor are P-type transistor or N-type transistor.

For example, in order to simplify the production process, in the above shift register provided by embodiments of the present disclosure, all of the first switching transistor, the second switching transistor, the third switching transistor and the fourth switching transistor are P-type transistor or N-type transistor.

The above are only examples illustrating a specific structure of the selection output unit in the shift register. When the present disclosure is carried out in detail, the specific structure of the selection output unit includes but not be limited to the above structure provided by embodiments of the present disclosure, and it further includes other structure known by those skilled in the art; and there is no limitation thereto.

For example, in the above shift register provided by embodiments of the present disclosure, the node control unit is configured to control the potential of the second node based on the first node and control the potential of the first node based on the second node so as to realize the basic function of the shift register by controlling the potential of the first node and the second node.

Further, in the above shift register provided by embodiments of the present disclosure, all structure of the input unit, reset unit, node control unit, pull-up unit and pull-down unit are same as the prior art, here it will not be expanded. The following is illustrated by a specific embodiment, and there is no limitation thereto.

Embodiment 1

Figure 4:
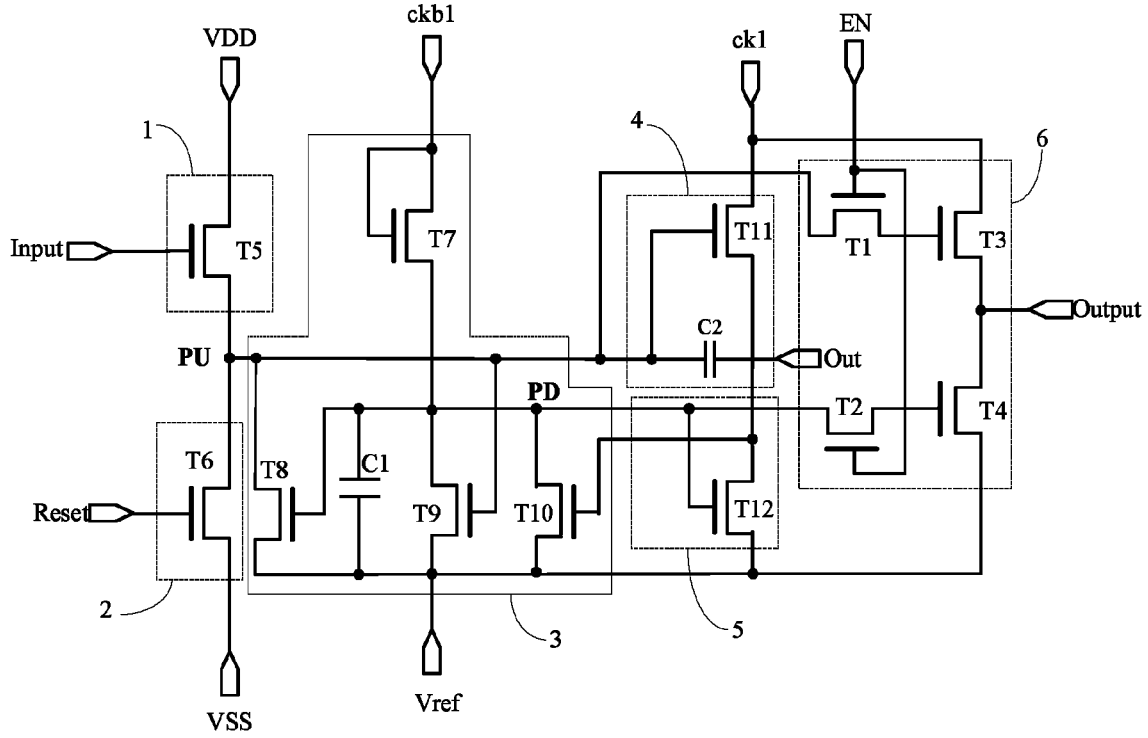
FIG. 4 is a schematic diagram of the specific structure of the shift register provided by the embodiment of the present disclosure.

For example, as shown in FIG. 4, the input unit 1 may include a fifth switching transistor T5; the reset unit 2 may include a sixth switching transistor T6; the node control unit 3 may include a seventh switching transistor T7, an eighth switching transistor T8, a ninth switching transistor T9, a tenth switching transistor T10 and a first capacitor C1; the pull-up unit 4 may include an eleventh switching transistor T11 and a second capacitor C2; the pull-down unit 5 may include a twelfth switching transistors T12; wherein the gate of the fifth switching transistor T5 is connected to the input signal terminal Input, the source thereof is connected to a first direct current signal terminal VDD, and the drain thereof is connected to a pull-up node PU; the gate of the sixth switching transistor 16 is connected to a reset signal terminal Reset, the source thereof is connected to a second direct current signal terminal VSS, and the drain thereof is connected to the first node PU; both the gate and source of the seventh switching transistor T7 are connected to a second clock signal terminal ckb1, and a drain thereof is connected to the second node PD; the gate of the eighth switching transistor T8 is connected to the second node PD, the source thereof is connected to a reference signal terminal Vref, and the drain thereof is connected to the first node PU; the gate of the ninth switching transistor T9 is connected to the first node PU, the source thereof is connected to the reference signal terminal Vref, and the drain thereof is connected to the second node. PD; the gate of the tenth switching transistor T10 is connected to the driving signal output terminal Out, the source thereof is connected to the reference signal terminal Vref, and the drain thereof is connected to the second node PD; the gate of the eleventh switching transistor T11 is connected to the first node PU, the source thereof is connected to a first clock signal terminal ck1, and the drain thereof is connected to the driving signal output terminal Out; the gate of the twelfth switching transistor T12 is connected to the second node PD, the source thereof is connected to the reference signal terminal Vref, and the drain thereof is connected to the driving signal output terminal Out; the first capacitor C1 is connected between the second node PD and the reference signal terminal Vref; and the second capacitor C2 is connected between the first node PU and the driving signal output terminal Out.

For example, all the switching transistors in FIG. 4 are N-type transistor. However, when the present disclosure is carried out in detail, all the switching transistors may be P-type transistors as well; or part of the transistors are N-type transistor, other part of the transistors are P-type transistor; and there is no limitation thereto.

Figure 5:
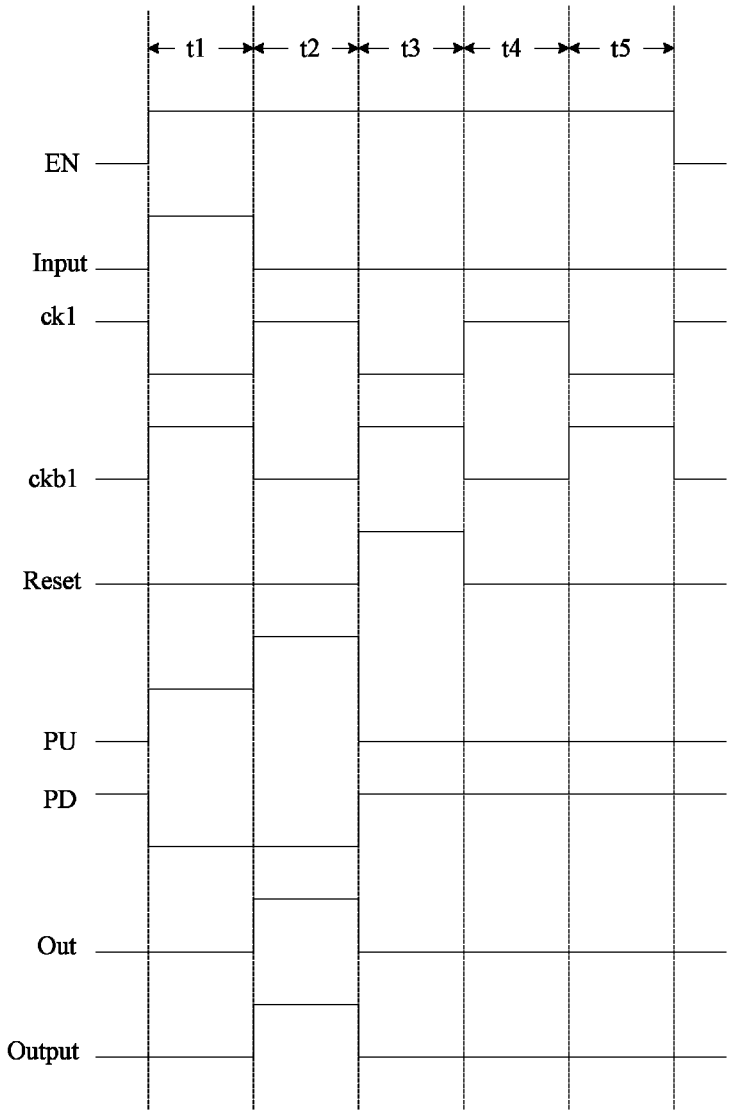
FIG. 5 is a timing chart of input and output corresponding to the shift register as shown in FIG. 4.

For example, the shift register shown in FIG. 4 is used as an example to illustrate how the shift register provided by embodiments of the present disclosure works. As shown in FIG. 5, the corresponding timing chart can be divided into the following five phases: t1, t2, t3, t4 and t5. In the following description, 1 represents high level signal, 0 represents low level signal.

In the first phase t1, Input=1, ck1=0, ckb1=1, Reset=0, EN=1.

As Input=1, the fifth switching transistor T1 is turned on, the potential of the first node PU is at the high level; the eleventh switching transistor T11 is turned on, the potential of the driving signal output terminal Out is at the low level, as ckb1=1, the seventh switching transistor T7 is turned on; meanwhile, since the potential of the first node PU is at the high level, the ninth switching transistor T9 is turned on, and the potential of the second node PD is at the low level. Since EN=1, the first switching transistor T1 and the second switching transistor T2 are turned on, the potential of the gate of the third switching transistor T3 is at the high level, the third switching transistor T3 is turned on, and the potential of the selection driving output terminal is at the low level.

In the second phase t2, Input=0, ck1=1, ckb1=0, Reset=0, EN=1.

Since ck1=1 and due to the bootstrap effect of the second capacitor, the potential of the first node PU is further pulled up, the eleventh switching transistor T11 is turned on, and the potential of the driving signal output terminal Out is at the high level. Since the potential of the first node PU is at the high level, the ninth switching transistor T9 is turned on, and the potential of the second node PD is at the low level. Since the potential of the driving signal output terminal Out is at the high level, the tenth switching transistor T10 is turned on, and the potential of the second node PD is at the low level. Since EN=1, the first switching transistor is turned on and the second switching transistor T2 is turned on, the potential of the gate of the third switching transistor T3 is at the high level, the third switching transistor T3 is turned on, and the potential of the selection driving output terminal Output is at the high level.

In the third phase t3, Input=0, ck1=0, ckb1=1, Reset=1, EN=1.

Since Reset=1, the sixth switching transistor T6 is turned on, the potential of the first node PU is at the low level. Since ckb1=1, the seventh switching transistor T7 is turned on, the potential of the second node PD is at the high level; the twelfth switching transistor T12 is turned on, the potential of the driving signal output terminal Out is at the low level. Since the potential of the second node PD is at the high level, the eighth switching transistor T8 is turned on, the potential of the first node PU is at the low level. Since EN=1, the first switching transistor T1 and the second switching transistor T2 are turned on, the potential of the gate of the fourth switching transistor T4 is at a high level, the fourth switching transistor T4 is turned on, and the potential of the selection driving output terminal Output is at the low level.

In the fourth phase t4, Input=0, ck1=1, ckb1=0, Reset=0, EN=1.

Since the effect of the first capacitor C1, the potential of the second node PD remains at a high level, the twelfth switching transistor T12 is turned on, and the potential of the driving signal output terminal Out is at the low level, Since the potential of the second node PD is at the high level, the eighth switching transistor T8 is turned on, and the potential of the first node PU is at the low level. Since EN=1, the first switching transistor T1 and the second switching transistor T2 are turned on, the potential of the gate of the fourth switching transistor T4 is at a high level, the fourth switching transistor T4 is turned on, and the potential of the selection driving output terminal Output is at the low level.

In the fifth phase t5, Input=0, ck1=0, ckb1=1, Reset=0, EN=1.

Since ckb1=1, the seventh switching transistor T7 is turned on, the potential of the second node PD is at a high level, the twelfth switching transistor T12 is turned on, and the potential of the driving signal output terminal Out is at the low level. Since the potential of the second node PD is at the high level, the eighth switching transistor T8 is turned on, the potential of the first node PU is at the low level. Since EN=1, the first switching transistor T1 and the second switching transistor T2 are turned on, the potential of the gate of the fourth switching transistor T4 is at a high level, the fourth switching transistor T4 is turned on, and the potential of the selection driving output terminal is at the low level.

Thereafter, the shift register repeats the fourth and fifth phase until the potential of the input signal terminal input goes high level again.

It should be noted that the switching transistor described in the above embodiments of the present disclosure may be a thin film transistor (TFT, Thin Film Transistor), may be a metal oxide semiconductor (MOS, Metal Oxide Semiconductor), and there is no limitation thereto. In a specific embodiment, the source and drain of these switching transistors may be interchanged according to the difference of types of transistor and input signal; and there is no specific distinction thereto.

Figure 6:
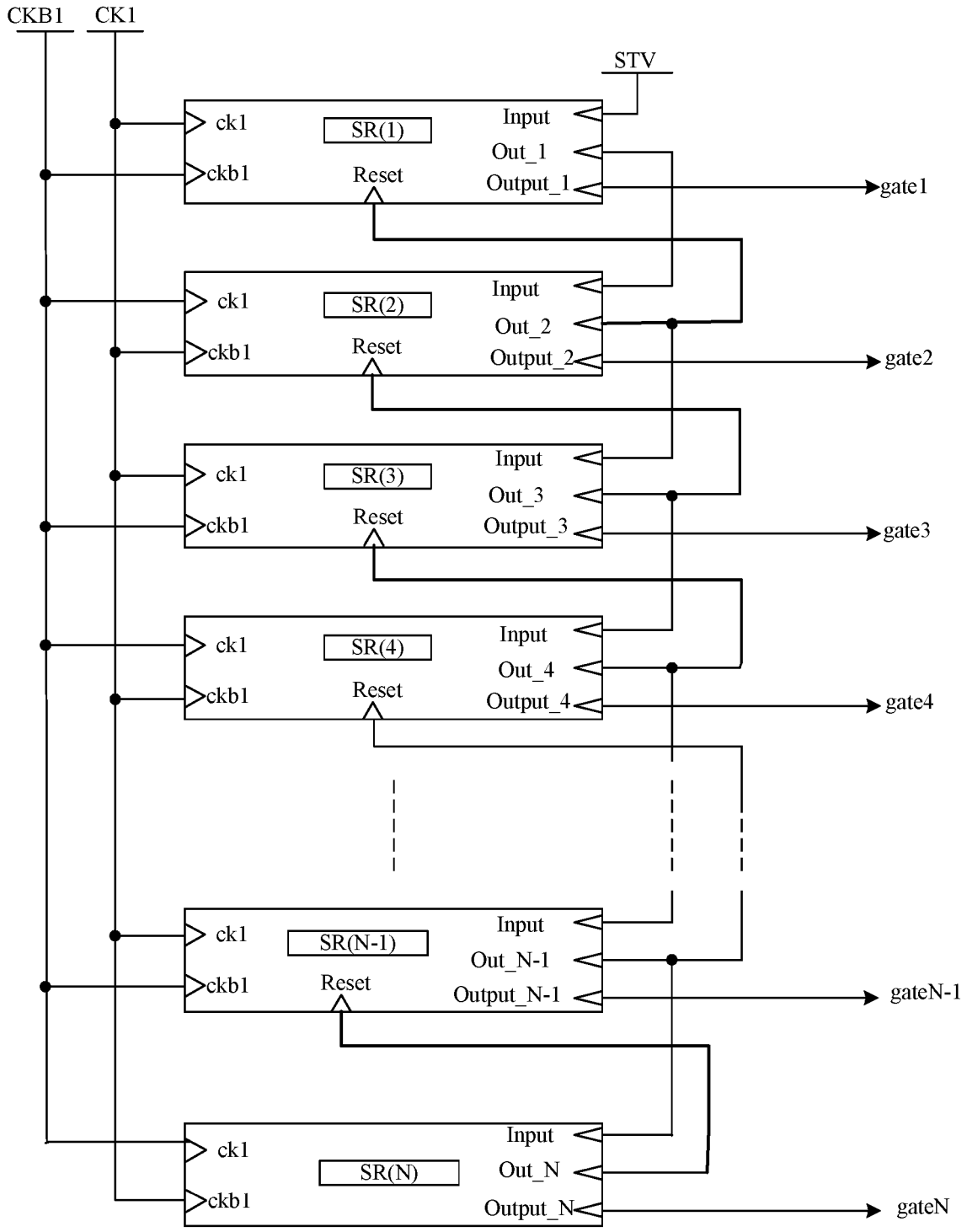
FIG. 6 is a schematic diagram of the structure of a gate driving circuit provided by the embodiment of the present disclosure.

Based on the same inventive idea, embodiments of the present disclosure further provides a gate driving circuit shown in FIG. 6 that includes a plurality of the above shift registers in cascade provided by the embodiments of the present disclosure; SR (1), SR (2) . . . SR (m) . . . SR (N−1), SR (N) (total of N shift registers, $1 \leq m \leq N$); wherein, except for a shift register at last stage, driving signal output terminal OUT_m ($1 \leq m \leq N$) of each of the shift register SR(m) is connected to input signal terminal Input of its adjacent shift register SR(M+1) at a next stage;

signal input terminal Input of a shift register SR(1) at the first stage is configured to receive trigger signal;

except for the shift register at the first stage SR (1), driving signal output terminal OUT_m of each of the shift register SR(m) is connected to reset signal terminal Reset of its adjacent shift register SR(m−1) at a previous stage;

selection driving output terminal Output_m of each of the shift register SR(m) is used for connecting to a gate line.

The gate driving circuit is connected through the selection driving output terminal Output_in of each of the shift register SR(m) to the corresponding gate line gatem, and it is configured to output scan signals to the corresponding gate line sequentially.

In the gate driving circuit provided by the embodiments of the present disclosure, only when selection output unit in the shift register at m-th stage is in on state under the control of the corresponding selection control signal terminal, scan signal would be outputted on the m-th gate line. When selection output units in all the shift register are in on state, the gate driving circuit outputs scan signal to the corresponding gate lines sequentially.

Further, in the gate driving circuit provided by the embodiments of the present disclosure, as shown in FIG. 6; the first clock signal terminal ck1 of the shift register odd-numbered stages and the second dock signal terminal ckb1 of the shift register at even-numbered stages are usually configured to receive the same clock signal (represented as CK1 in the drawing), and the second clock signal terminal ckb1 of the shift register at odd-numbered stages and the first clock signal terminal ck1 of the shift register at even numbered stages are usually configured to receive the same clock signal (represented as CKB1 in the drawing).

Figure 7A:
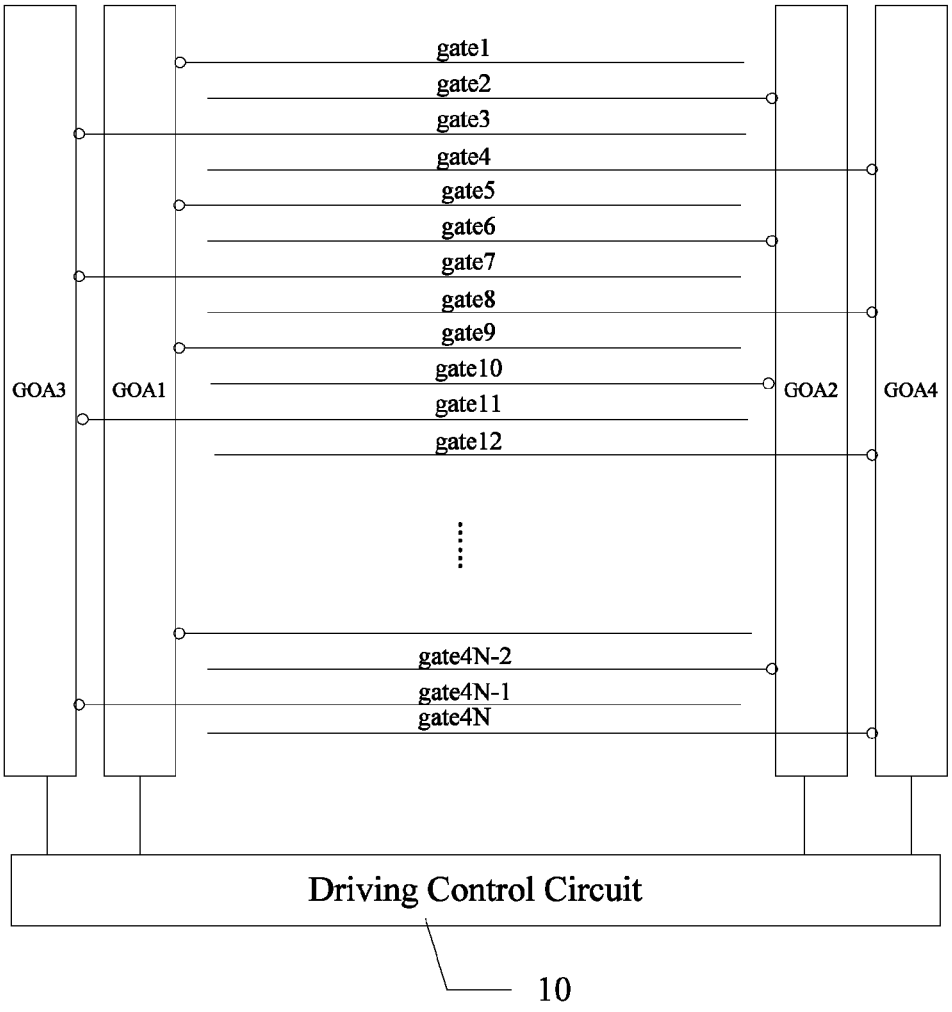
FIGS. 7*a* and 7*b* are schematic diagrams of the structure of a display panel provided by the embodiment of the present disclosure respectively.
Figure 7B:
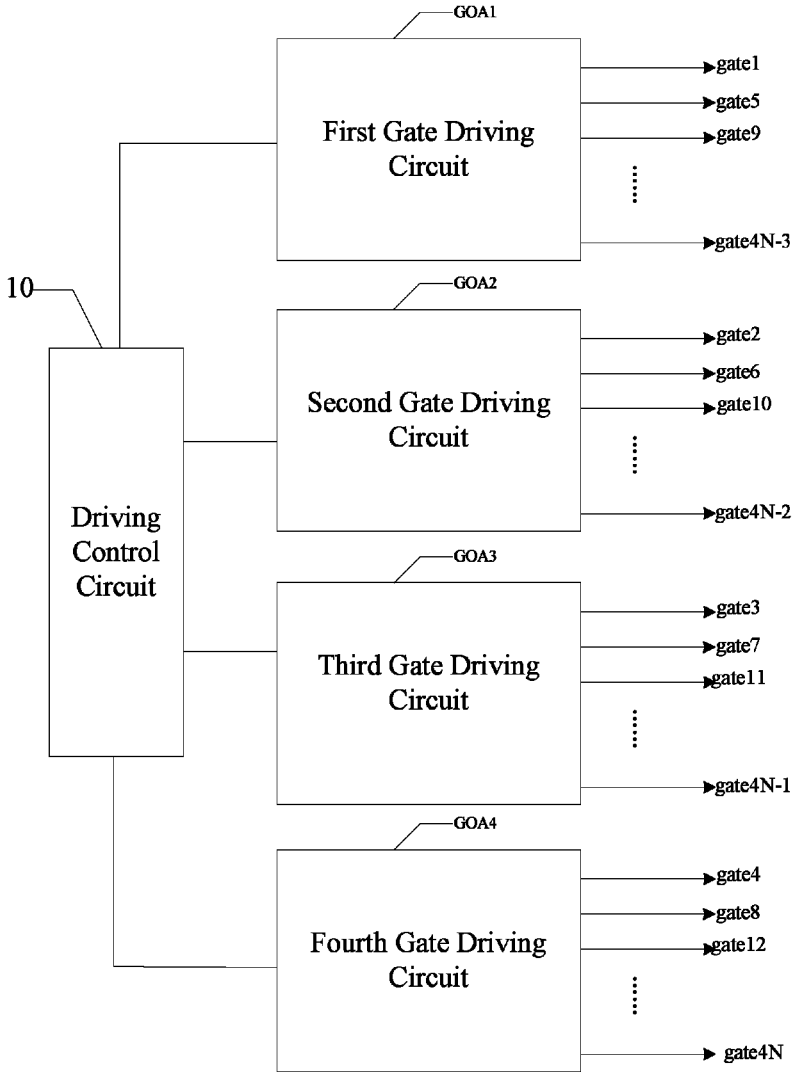

Based on the same inventive idea, embodiments of the present disclosure further provides a display panel, as shown in FIGS. 7*a* and 7*b*, which comprises: 4N gate lines (gate1, gate2, gate3 . . . ), a first gate driving circuit GOA1 and a third gate driving circuit GOA3 located at one side of the display panel, a second gate driving circuit GOA2 and a fourth gate driving circuit GOA4 located at the other side of the display panel; wherein all the first gate driving circuit GOA1, second gate driving circuit GOA2, third gate driving circuit GOA3 and fourth gate driving circuit GOA4 are the above gate driving circuit provided by embodiments of the present disclosure;

Wherein selection driving output terminal of each of the shift register in the first gate driving circuit GOA1 is connected to the (4n+1)th gate lines (gate1, gate5, gate9 . . . ) respectively, selection driving output terminal of each of the shift register in the second gate driving circuit GOA2 is connected to the (4n+2)th gate lines (gate2, gate6, gate10 . . . , respectively, selection driving output terminal of each of the shift register in the third gate driving circuit GOA3 is connected to the (4n+3)th gate lines (gate3, gate7, gate11, . . . ) respectively, selection driving output terminal of each of the shift register in the fourth gate driving circuit GOA4 is connected to the (4n+4)th gate lines (gate4, gate8, gate12 . . . ) respectively, wherein n is an integer larger than and equal to 0 but smaller than N;

the display panel further comprises: a driving control circuit 10, connected to each of the gate driving circuits (GOA1, GOA2, GOA3 and GOA4), is at least configured to output selection control signal to each of the gate driving circuit (GOA1, GOA2, GOA3 and GOA4), output a first set of time sequence control signal (at least including the first trigger signal STV1, the first clock signal CK1 and the second clock signal CKB1) to the first gate driving circuit GOA1, output a second set of time sequence control signal (at least including the second trigger signal STV2, the third clock signal CK2 and the fourth clock signal CKB2) to the second gate driving circuit GOA2, output a third set of time sequence control signal (at least including the third trigger signal STV3, the fifth clock signal CK3 and the sixth clock signal CKB3) to the third gate driving circuit GOA3, and output a fourth set of time sequence control signal (at least including the fourth trigger signal STV4, the seventh clock signal CK4 and the eighth clock signal CKB4) to the fourth gate driving circuit GOA4; wherein each set of time sequence control signal at least includes trigger signal and clock signal, the width of the trigger signal in each set of time sequence control signal is same, and each of the gate driving circuit (GOA1, GOA2, GOA3 and GOA4) is configured to let the driving signal output terminal output scanning signal sequentially under the control of its corresponding set of the received time sequence control signal.

Figure 8A:
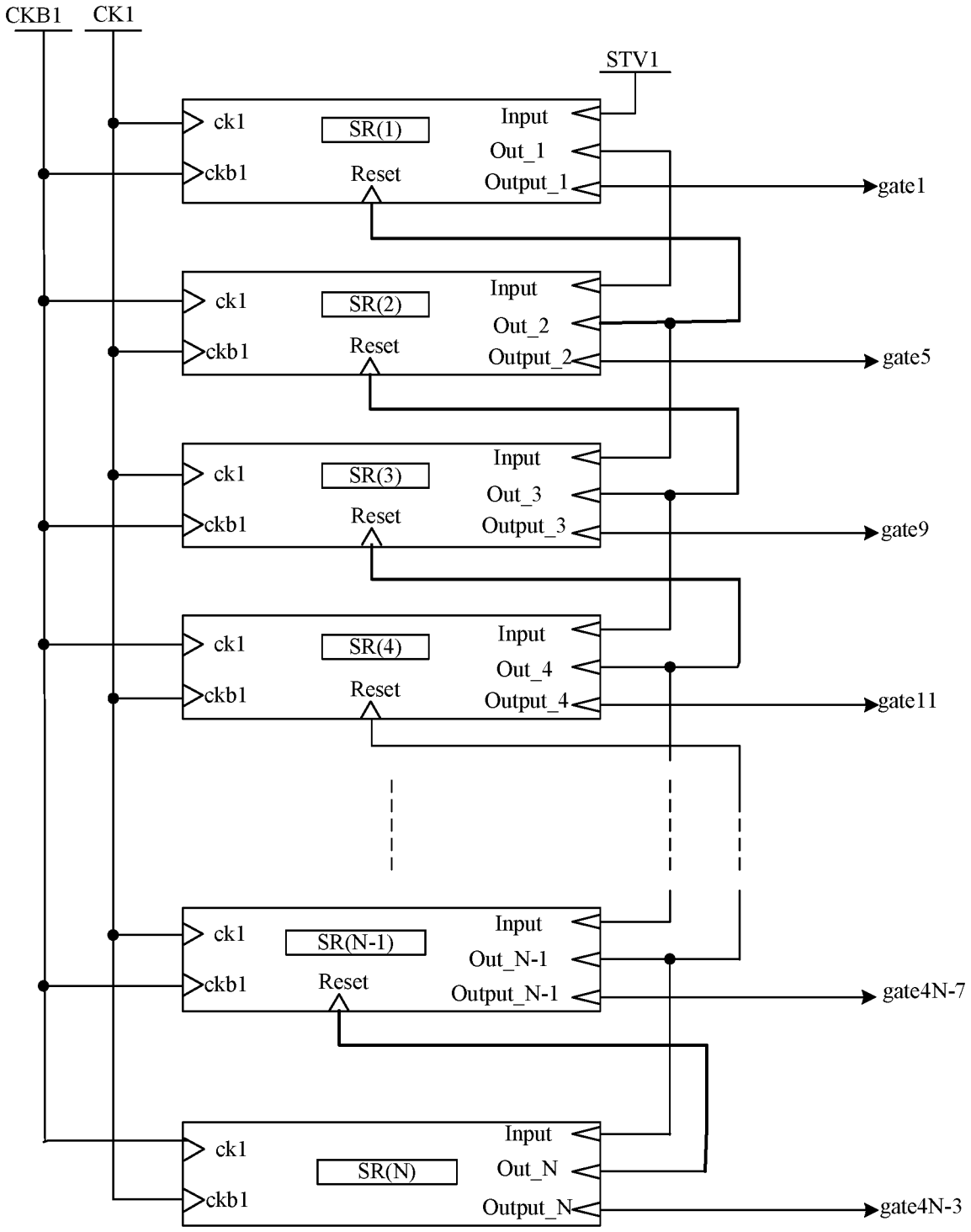
FIG. 8*a* is a schematic diagram of the structure of a first gate driving circuit provided by the embodiment of the present disclosure.

Using the first gate driving circuit GOA1 as an example, the following example will illustrate the control of a set of time sequence control signal over a gate driving circuit. As shown in FIG. 8*a*, the driving control circuit 10 inputs the first trigger signal STV1 to the shift register SR (1) at the first stage, inputs the first clock signal CK1 to the first clock signal terminal ck1 of the shift register at odd-numbered stages and the second clock signal terminal ckb1 of the shift register at even-numbered stages, and inputs the second clock signal CKB1 to the second clock signal terminal ckb1 of the shill register at odd-numbered stages and the first clock signal terminal ck1 of the shift register at even-numbered stages.

Figure 8B:
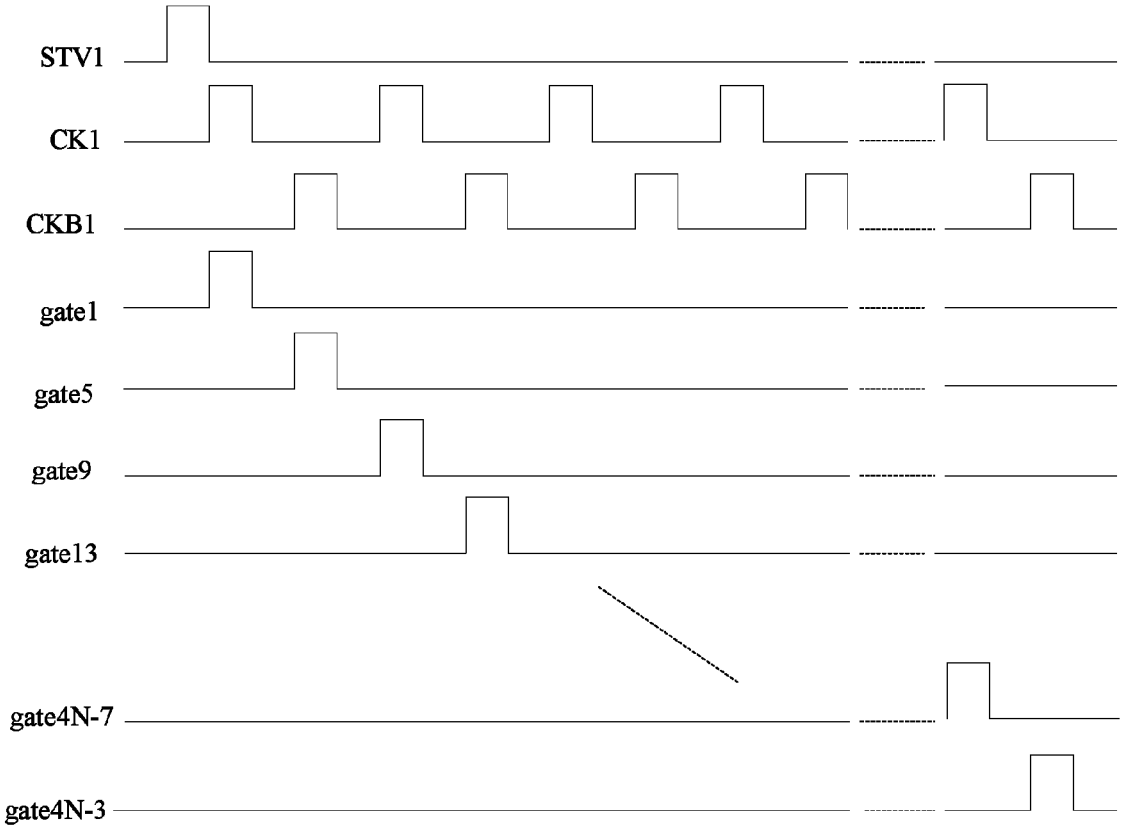
FIG. 8*b* is a timing chart of input and output of the first gate driving circuit as shown in FIG. 8*a;*

After the shift register SR (1) at the first stage receives the first trigger signal STV1, driving signal output terminal Out-1 outputs scan signal when the first clock signal terminal ck1 receives the first clock signal CK1 at the first time; if the corresponding selection output unit receives selection control signal at the selection control signal terminal and then is in on state, the selection driving output terminal Output_1 outputs scan signal to the first gate line gate1, scan signal outputted by the driving signal output terminal Out-1 of the shift register SR (1) at the first stage is provided for input signal terminal Input of the shift register SR (2) at the second stage; after the shift register SR (2) at the second stage receives scan signals outputted by the shift register SR (1) at the first stage; driving signal output terminal Out-2 outputs scan signal when the first clock signal terminal ck1 receives the second clock signal CKB1 at the first time, if the corresponding selection output unit receives selection control signal at the selection control signal terminal and then is in on state, the selection driving output terminal Output_2 outputs scan signal to the fifth gate line gate5, scan signal outputted by the driving signal output terminal Out-2 of the shift register SR (2) at the second stage is provided for input signal terminal input of the shift register SR (3) at the third stage; after the shift register SR (3) at the third stage receives scan signals outputted by the shift register SR (2) at the second stage, driving signal output terminal Out-3 outputs scan signal when the first clock signal terminal ck1 receives the first clock signal CK1 at the first time, if the corresponding selection output unit receives selection control signal at the selection control signal terminal and then is in on state, the selection driving output terminal Output_3 outputs scan signal to the ninth gate line gate9, scan signal outputted by the driving signal output terminal Out-3 of the shift register SR (3) at the third stage is provided for input signal terminal Input of the shift register SR (4) at the fourth stage; and the rest may be deduced by analogy, each of the shift register outputs scan signal to the corresponding gate line. FIG. 8*b* has shown the specific timing chart of input and output of the first gate driving circuit.

For example, the driving control circuit inputs the second trigger signal to the shift register at the first stage of the second gate driving circuit, inputs the third clock signal to the first clock signal terminal of the shift, register at odd-numbered stages and the second clock signal terminal of the shift register at even-numbered stages, respectively, and inputs the fourth clock signal to the second clock signal terminal of the shift register at odd-numbered stages and the first clock signal terminal of the shift register at even-numbered stages, respectively. The driving control circuit inputs the third trigger signal to the shift register at the first stage of the third gate driving circuit, inputs the fifth clock signal to the first clock signal terminal of the shift register at odd-numbered stages and the second clock signal terminal of the shift register at even-numbered stages, respectively, and inputs the sixth clock signal to the second clock signal terminal of the shift register at odd-numbered stages and the first clock signal terminal of the shift register at even-numbered stages, respectively. The driving control circuit inputs the fourth trigger signal to the shift register at the first stage of the fourth gate driving circuit, inputs the seventh clock signal to the first clock signal terminal of the shift register at odd-numbered stages and the second clock signal terminal of the shift register at even-numbered stages, respectively, and inputs the eighth clock signal to the second clock signal terminal of the shift register at odd-numbered stages and the first clock signal terminal of the shift register at even-numbered stages, respectively.

Figure 9A:
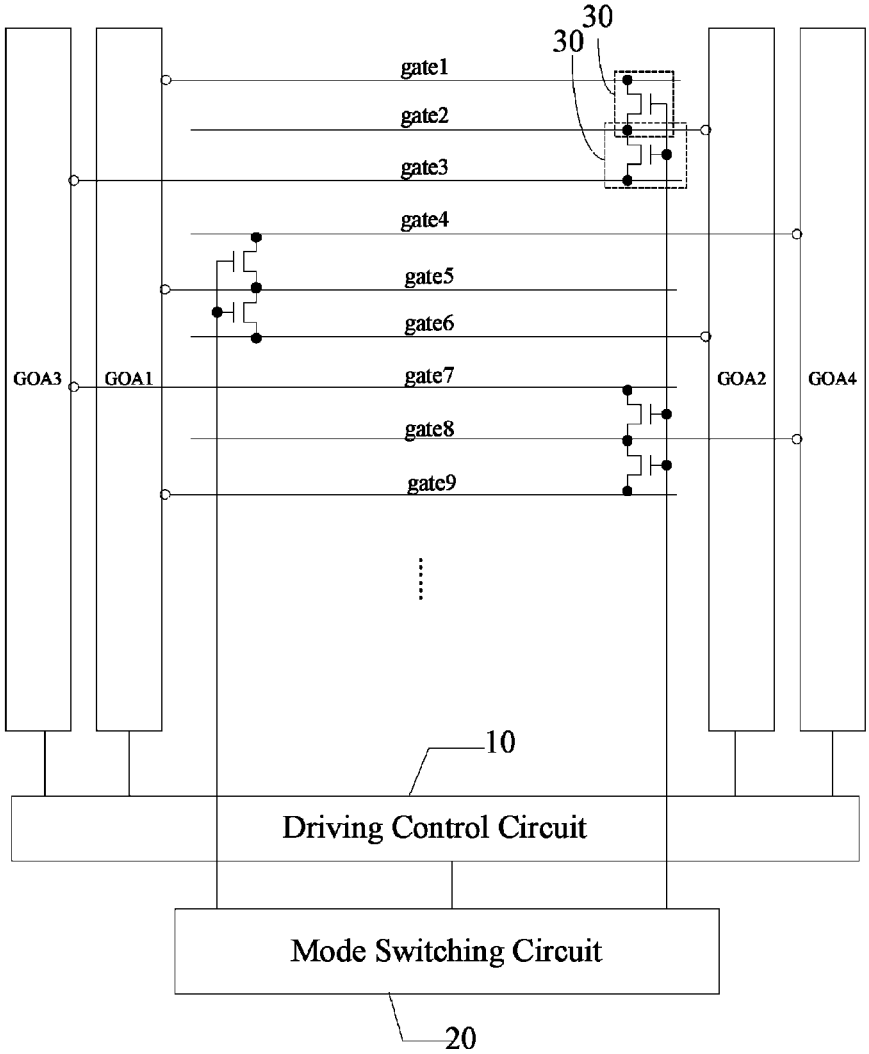
FIG. 9*a* is a schematic diagram of the structure of the display panel provided by the embodiment of the present disclosure.
Figure 9B:
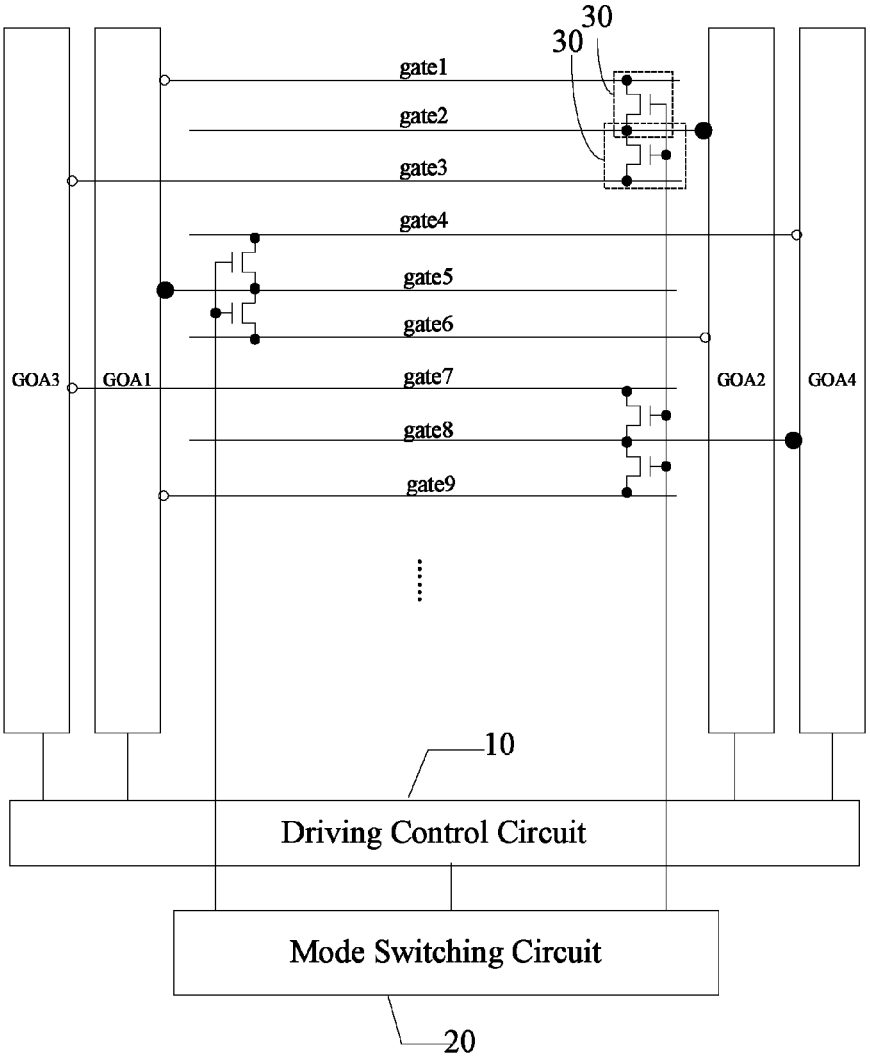
FIG. 9*b* is a schematic diagram of the structure of the display panel when the first mode control signal is received by the mode switching circuit.
Figure 10A:
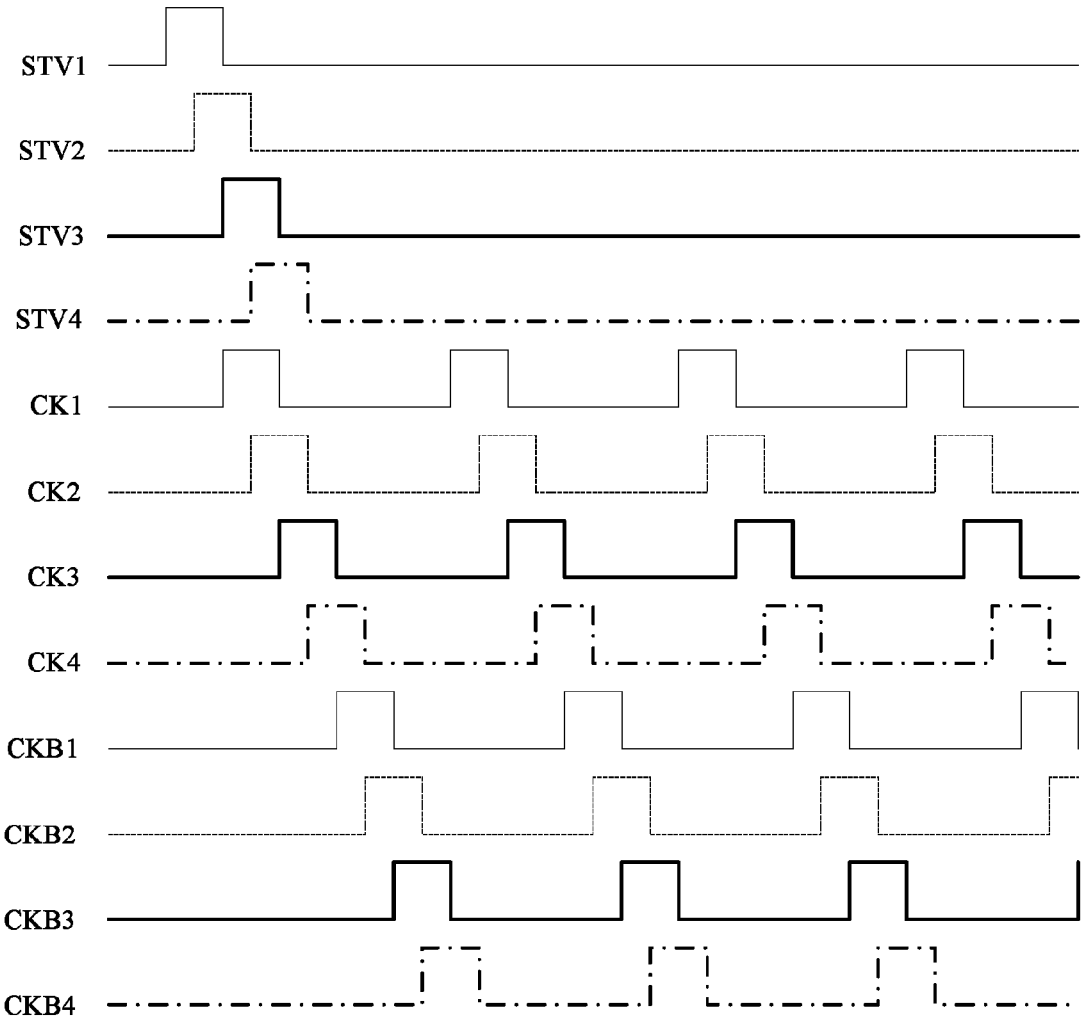
FIG. 10*a* is a timing chart of four sets of time sequence control signal in the display panel provided by the embodiment of the present disclosure controlling the driving control circuit to output when the first mode control signal or the third mode control signal is received by the mode switching circuit.
Figure 10B:
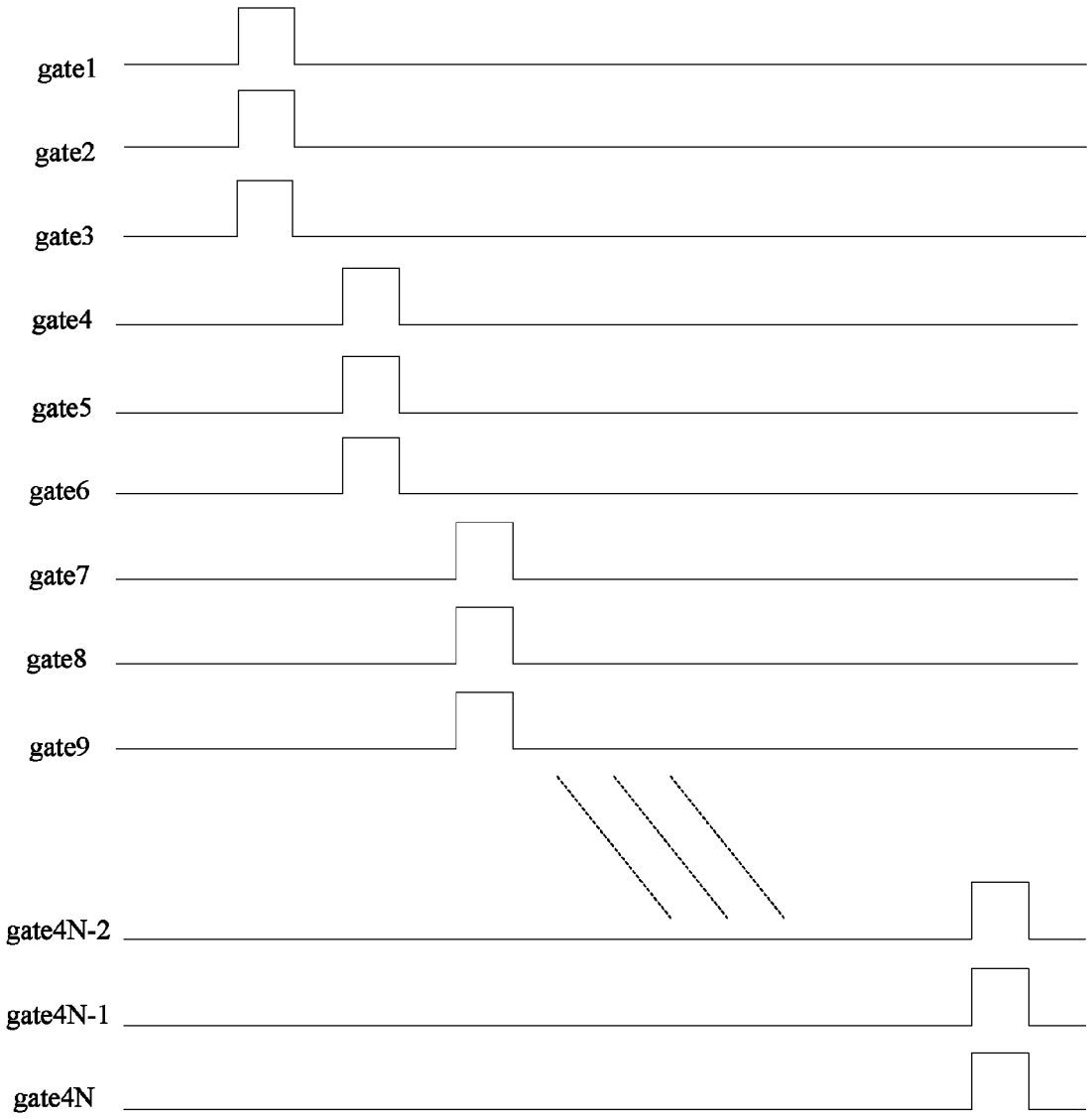
FIG. 10*b* is a timing chart of scan signal on the corresponding gate line in the display panel provided by the embodiment of the present disclosure when the first mode control signal is received by the mode switching circuit.

Specific working principle of the second gate driving circuit, the third gate driving circuit and fourth gate driving circuit is same as that of the first gate driving circuit, thus the repetitious details need not be given here, For example, as shown in FIG. 9, the display panel provided by embodiments of the present disclosure further comprises: a mode switching circuit 20 connected to the driving control circuit 10; for each value of m, switching devices 30 that are connected between the (3m+1)th gate line and (3m+2)th gate line, respectively; for each value of m, switching devices 30 that are connected between the (3m+2)th gate line and (3m+3)th gate line, respectively; each of the switching devices 30 is connected to the mode switching circuit 20; wherein m is an integer larger than and equal to 0; in receiving a first mode control signal, the mode switching circuit 20 is configured to:

delay timing of each of signal in the second set of time sequence control signal (at least including the second trigger signal STV2, the third clock signal CK2 and the fourth clock signal CKB2) for one-half of the width of the trigger signal than timing of the corresponding signal in the first set of time sequence control signal (at least including the first trigger signal STV1, the first clock signal CK1 and the second clock signal CKB1); delay timing of each of signal in the third set of time sequence control signal (at least including the third trigger signal STV3, the fifth clock signal CK3 and the sixth clock signal CKB3) for one-half of the width of the trigger signal than timing of the corresponding signal in the second set of time sequence control signal; delay timing of each of signal in the fourth set of time sequence control signal (at least including the fourth trigger signal STV4, the seventh clock signal CK4 and the eighth clock signal CKB4) for one-half of the width of the trigger signal than timing of the corresponding signal in the third set of time sequence control signal; the specific timing chart of four sets of time sequence control signal is shown in FIG. 10*a*; the purpose thereof is to make sure there is scan signal outputted from the driving signal output terminal of each of the shift register sequentially;

and control the driving control circuit to output the selection control signal towards the selection control signal terminal of the shift register connected to the (3m+1)th gate line, or control the driving control circuit to output the selection control signal towards the selection control signal terminal of the shift register connected to the (3m+2)th gate line, or control the driving control circuit to output the selection control signal towards the selection control signal terminal of the shift register connected to the (3m+3)th gate line; the purpose thereof is to make the gate driving circuit to output the scan signal only towards (3m+1)th gate line or the (3m+2)th gate line or the (3m+3)th gate line sequentially; so as to control all the driving control circuit 10 to output the selection control signal towards the selection control signal terminal of the shift register connected to the (3m+2)th gate line gate 3m+2 as an example to illustrate that the gate driving circuit outputs the selection control signal towards the selection control signal terminal of the shift registers connected to the (3m+1)th gate line and the (3m+2)th gate line, thus the shift registers connected to the (3m+1)th gate line and the (3m+2)th gate line can output scan signal; as shown in FIG. 9*b*, the dot of the beginning of gate lines represents that selection control signal terminal of the shift register in the gate driving circuit has selection control signal and the corresponding selection driving output terminal can output scan signal; the circle of the beginning of gate lines indicates the selection control signal terminal of the shift register in the gate driving circuit has not selection control signal and the corresponding selection driving output terminal cannot output scan signal;

control all the switching devices 30 is in a on state so as to make (3m+1)th gate lines and (3m+2)th gate lines are turned on and (3m+2)th gate lines and (3m+3) gate lines are turned on; the purpose thereof is to make scan signal on the (3m+1)th gate lines, (3m+2)th gate lines and (3m+3)th gate lines same so that arranging three neighbouring gate lines as a set of gate line and each set of gate line receiving scan signal sequentially along the scanning direction can be achieved. That is, in the display panel, the three gate lines are scanned simultaneously so that the resolution of the display panel is reduced to a third of the resolution, Particularly, when the first mode control signal is received by the mode switching circuit, the display panel provided by embodiments of the present disclosure controlling the driving control circuit 10 to output the selection control signal towards the selection control signal terminal of the shift register connected to the (3m+2)th gate line is used as an example, and FIG. 10*b* shows a timing chart of scan signal on each of gate lines in the display panel along scanning direction.

Compared with the current display panel, the above display panel provided by embodiments of the present disclosure adds a selection output unit, switching devices connected to (3m+1)th gate lines and (3m+2)th gate lines respectively, switching devices connected to (3m+2)th gate lines and (3m+3)th gate lines respectively and mode switching circuits connected to the driving control circuit. So when the mode switching circuits receives the first mode control signal, arranging three neighbouring gate lines as a set of gate line along scanning direction and each set of gate line receiving scan signal sequentially along the scanning direction may be realized. The resolution of the display panel is reduced to a third of the resolution, this allows the display panel to reduce power consumption and extend the standby time.

It is necessary to note that: the switching devices connected to (3m+1)th gate lines and (3m+2)th gate lines respectively and switching devices connected to (3m+2)th gate lines and (3m+3)th gate lines respectively refer to switching devices that are set between the first gate line (m=1) and the second gate line (m=1) and switching devices that are set between the second gate line (m=1) and the third gate line (m=1); switching devices that are set between the fourth gate line (m=2) and the fifth gate line (m=2) and switching devices that are set between the fifth gate line (m=2) and the fifth gate line (m=2); the rest may be deduced by analogy, it can be concluded that no switching device is set only between the 3x-th gate lines (x is an integer larger than 0) and the (3x+1)th gate lines but there is switching device set between other adjacent gate lines.

Further, in the display panel provided by embodiments of the present disclosure, while receiving a second mode control signal, the mode switching circuit is also configured to:

control all the switching devices in the OFF state, and the purpose thereof is to ensure signal of all gate lines would not affect each other;

control the driving control circuit to output selection control signal towards the selection control signal terminal of all the shift register, and the purpose thereof is to make signal outputted by the selection driving output terminal of each of the shift register same as that outputted by its corresponding driving signal output terminal;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; and delay timing of each of signal in the fourth set of time sequence control signal for one-half of the width of the trigger signal than timing of the corresponding signal in the third set of time sequence control signal (that is, the mode switching circuit makes four sets of time sequence control signal outputted by the driving control circuit under the control of the mode switching circuit when it receives the second mode control signal same as four sets of time sequence control signal outputted by the driving control circuit under the control of the mode switching circuit when it receives the first mode control signal); the specific timing chart is as shown in FIG. 10*a*, the purpose thereof is to make the driving signal output terminal of each of the shift register output scan signal sequentially so as to realize the function of line by line scan along scanning direction, that is, the display panel with higher resolution, Consequently, the above display panel provided by embodiments of the present disclosure can not only be set to display with low resolution when there is a need to save power but also realize a display with high resolution when there is no need to save power.

Figure 11:
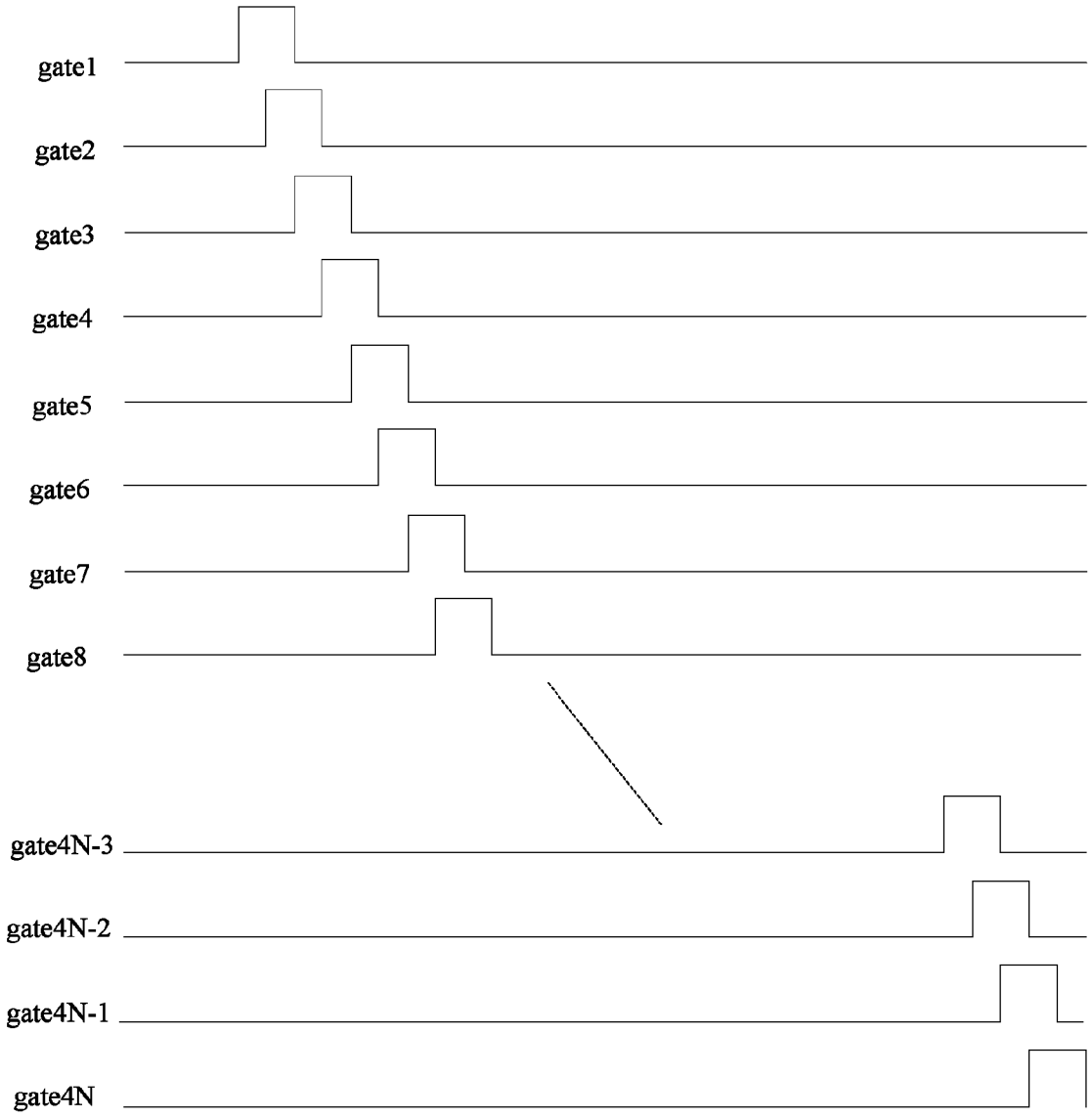
FIG. 11 is a timing chart of scan signal on the corresponding gate line in the display panel provided by the embodiment of the present disclosure when the second mode control signal is received by the mode switching circuit.

For example, in the above display panel provided by embodiments of the present invention, when the mode switching circuit receives the second mode control signal, the timing chart of scanning signal along scanning direction on each of gate lines of the display panel is shown in FIG. 11.

Figure 12A:
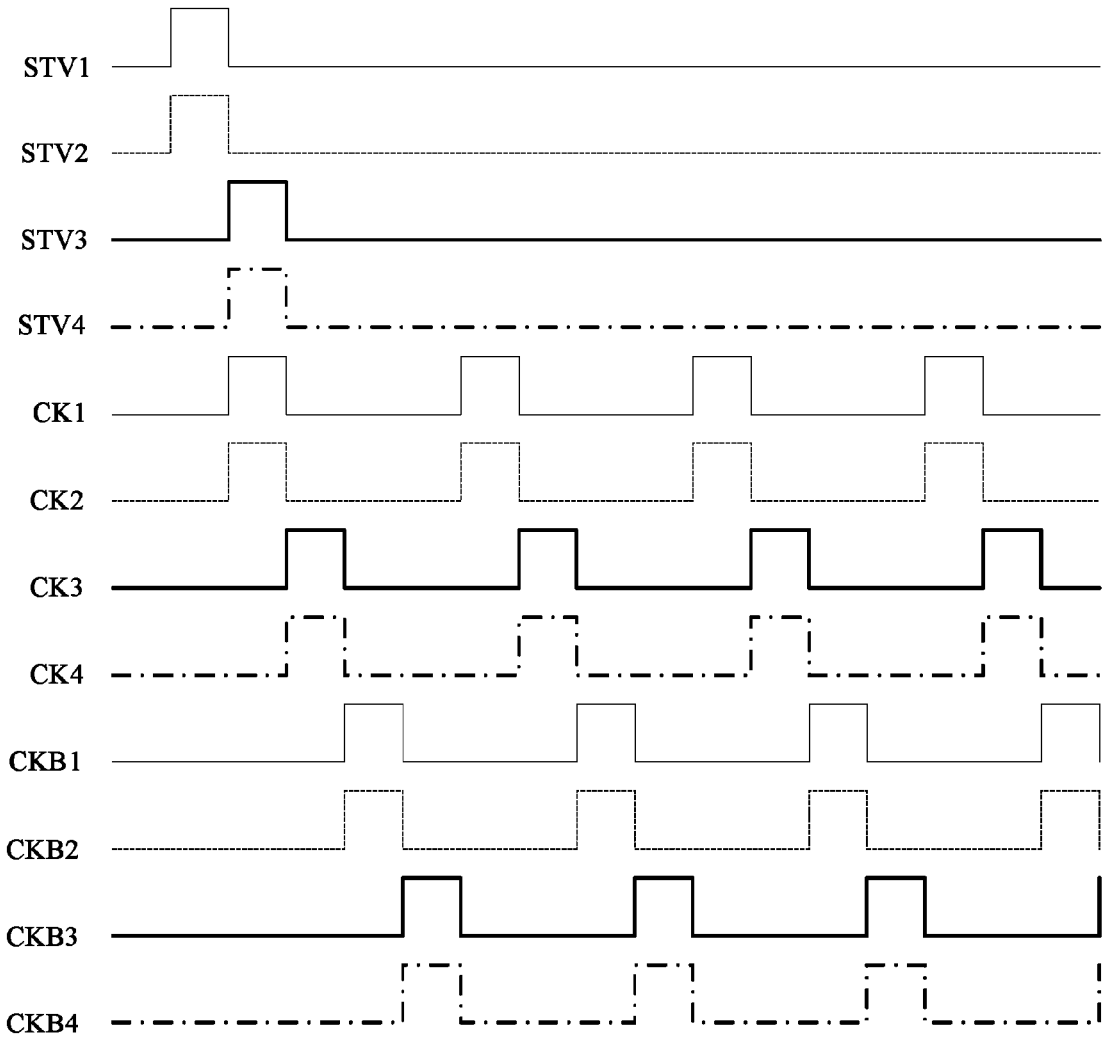
FIG. 12*a* is a timing chart of four sets of time sequence control signal in the display panel provided by the embodiment of the present disclosure controlling the driving control circuit to output when the third mode control signal is received by the mode switching circuit.

Further, in the display panel provided by embodiments of the present disclosure, while receiving a third mode control signal, the mode switching circuit is also configured to:

control all the switching devices in the OFF state, and the purpose thereof is to ensure signal of all gate lines would not affect each other;

control the driving control circuit to output selection control signal towards the selection control signal terminal of all the shift register, and the purpose thereof is to make signal of the selection driving output terminal of each of the shift register same as that of its corresponding driving signal output terminal;

make timing of each of signal in the first set of time sequence control signal same as timing of the corresponding signal in the second set of time sequence control signal; make timing of each of signal in the third set of time sequence control signal same as timing of the corresponding signal in the fourth set of time sequence control signal; and delay timing of each of signal in the third set of time sequence control signal for one width of trigger signal than timing of the corresponding signal in the first set of time sequence control signal; the specific timing chart is as shown in FIG. 12*a*, the purpose thereof is to achieve in arranging two neighbouring gate lines as a set of gate line along scanning direction and receiving scan signal sequentially along the scanning direction from each set of gate line. That is, in the display panel, two gate lines are scanned simultaneously so that the resolution of the display panel is reduced to one-half of the resolution.

Figure 12B:
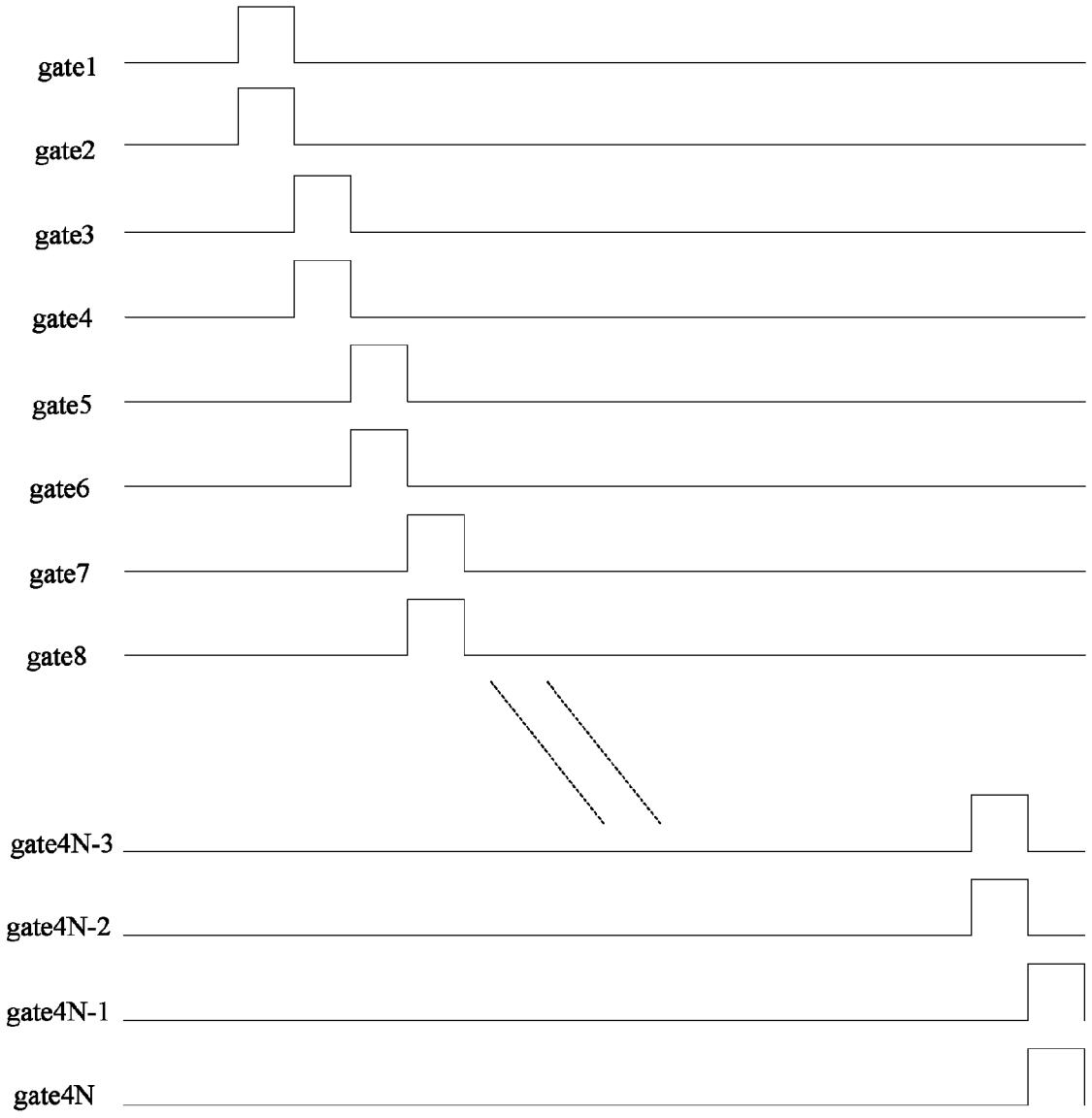
FIG. 12*b* is a timing chart of scan signal on the corresponding gate line in the display panel provided by the embodiment of the present disclosure when the third mode control signal is received by the mode switching circuit.

For example, in the above display panel provided by embodiments of the present invention, when the mode switching circuit receives the third mode control signal, the timing chart of scanning signal along scanning direction on each of gate lines of the display panel is shown in FIG. 12*b*.

Figure 13A:
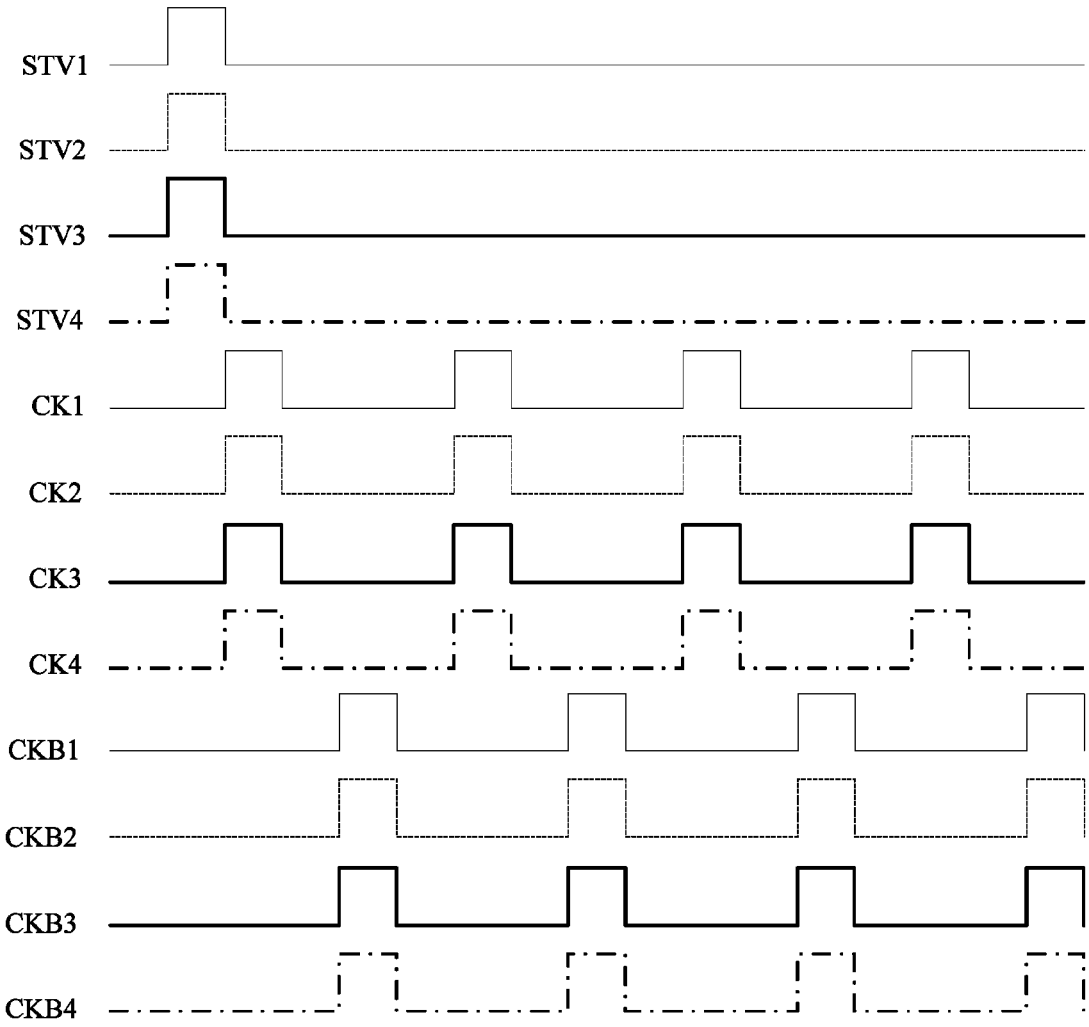
FIG. 13*a* is a timing chart of four sets of time sequence control signal in the display panel provided by the embodiment of the present disclosure controlling the driving control circuit to output when the fourth mode control signal is received by the mode switching circuit.

Further, in the display panel provided by embodiments of the present disclosure, while receiving a fourth mode control signal, the mode switching circuit is also configured to:

control all the switching devices in the OFF state, and the purpose thereof is to ensure signal of all gate lines would not affect each other;

control the driving control circuit to output selection control signal towards the selection control signal terminal of all the shift register, and the purpose thereof is to make signal of the selection driving output terminal of each of the shift register same as that outputted by its corresponding driving signal output terminal;

make timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal; the specific timing chart is as shown in FIG. 13*a*, the purpose thereof is to achieve in arranging four neighbouring gate lines as a set of gate line along scanning direction and receiving scan signal sequentially along the scanning direction from each set of gate line. That is, in the display panel, four gate lines are scanned simultaneously so that the resolution of the display panel is reduced to one fourth of the resolution.

Figure 13B:
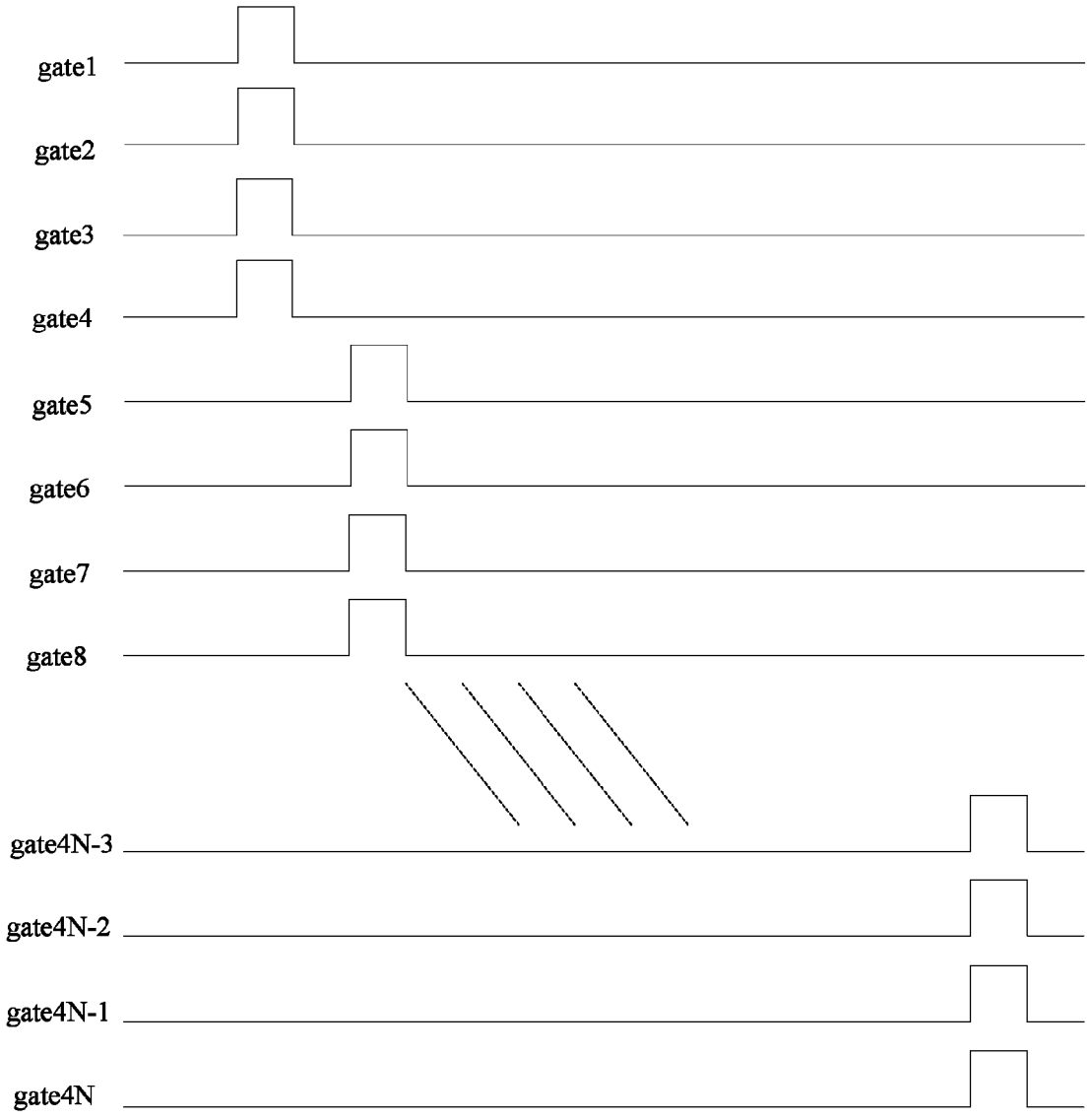
FIG. 13*b* is a timing chart of scan signal on the corresponding gate line in the display panel provided by the embodiment of the present disclosure when the fourth mode control signal is received by the mode switching circuit.

For example, in the above display panel provided by embodiments of the present invention, when the mode switching circuit receives the fourth mode control signal, the timing chart of scanning signal along scanning direction on each of gate lines of the display panel is shown in FIG. 13*b*.

Further, in the display panel provided by embodiments of the present disclosure, switching devices may be switching transistors or other electronic switching control modules, and there is no limitation thereto.

It should be noted that, in the first mode control signal, the second mode control signal, the third mode control signal and the fourth mode control signal of the display panel of embodiments of the present disclosure, time of maintaining each mode control signal is an integral multiple of time of scanning 4N gate lines, and switching point between any two mode control signal is synchronized with starting point of scanning gate lines.

In particular, the display panel provided by embodiments of the present disclosure sets selection input unit in the shift register, adds switching devices between gate lines and controls timing of four sets of time sequence control signal, thus reduce the resolution. Although embodiments of the present disclosure only provide four cases, the display panels with one fifth of resolution, one sixth of resolution, and so on, obtained based on the above idea are also belong to the protection scope of the present disclosure.

When the present disclosure is carried out in detail, in the display panel provided by embodiments of the present disclosure, the user can transmit mode control signal to mode switching circuits through operation interface of the display panel in accordance with the actual demands, and there is no limitation thereto.

Further, the display panel provided by embodiments of the present disclosure may not only be a liquid crystal display panel but also an organic electroluminescent display panel, and there is no limitation thereto.

Based on the same inventive idea, embodiment of the present disclosure further provides a display device comprising any of the display panel provided by embodiments of the present disclosure. The display device may be: mobile phones, tablet computers, televisions, monitors, notebook computers, digital picture frames, navigation systems and other products or component having a display function. The implementation of the display device can see examples of the display panel, thus the repetitious details need not be given here.

Based on the same inventive idea, embodiments of the present disclosure further provides a driving method of the display panel, comprising:

in receiving a first mode control signal, the mode switching circuit controls all the switching devices in the ON state; delays timing of each of signal in the second set of time sequence control signal for one-half of the width of the trigger signal than timing of the corresponding signal in the first set of time sequence control signal; delays timing of each of signal in the third set of time sequence control signal for one half of the width of the trigger signal than timing of the corresponding signal in the second set of time sequence control signal; delays timing of each of signal in the fourth set of time sequence control signal tot one-half of the width of the trigger signal than timing of the corresponding signal in the third set of time sequence control signal; and controls all the driving control circuits to output selection control signal towards selection control signal terminal of the shift register connected to the (3m+1)th gate line, or controls all the driving control circuits to output the selection control signal towards selection control signal terminal of the shift register connected to the (3m+2)th gate line, or controls all the driving control circuit to output the selection control signal towards the selection control signal terminal of the shift register connected to the (3m+3)th gate line;

or, in receiving a second mode control signal, the mode switching circuit: controls all the switching devices in the OFF state; delays timing of each of signal in the second set of time sequence control signal for one-half of the width of the trigger signal than timing of the corresponding signal m the first set of time sequence control signal; delays timing of each of signal in the third set of time sequence control signal for one-half of the width of the trigger signal than timing of the corresponding signal in the second set of time sequence control signal; delays timing of each of signal in the fourth set of time sequence control signal for one-half of the width of the trigger signal than timing of the corresponding signal in the third set of time sequence control signal; and controls all the driving control circuits to output selection control signal towards the selection control signal terminal of all the shift register;

or, in receiving a third mode control signal, the mode switching circuit controls all the switching devices in the OFF state; makes timing of each of signal in the first set of time sequence control signal same as timing of the corresponding signal in the second set of time sequence control signal; makes timing of each of signal in the third set of time sequence control signal same as timing of the corresponding signal in the fourth set of time sequence control signal; and delays timing of each of signal in the third set of time sequence control signal for one width of trigger signal than timing of the corresponding signal in the first set of time sequence control signal; and controls all the driving control circuits to output selection control signal towards the selection control signal terminal of all the shift register;

or, in receiving a fourth mode control signal, the mode switching circuit controls all the switching devices in the OFF state; makes timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal; and controls all the driving control circuits to output selection control signal towards the selection control signal terminal of all the shift register.

Embodiments of the present disclosure provide a shift register; a driving method of a display panel and related device. The shift register corresponds to the current shift register with added selection output unit and selection control signal terminal; the selection output unit uses its output terminal to output signal that is same as signal of the driving signal output terminal of the shift register when the selection control signal terminal receives selection control signal. Moreover, by the control of the selection control signal terminal and the selection output unit to determine whether there is scan signal outputted from the selection driving output terminal. Further, when gate-driving circuit consisting of the above shift register is used, selectively outputting scan signal to certain gate lines can be achieved. Further, in the display panel provided by embodiments of the present disclosure, the above gate-driving circuit is used, and switching devices connected to (3m+1)th gate lines and (3m+2)th gate lines respectively, switching devices connected to (3m+2)th gate lines and (3m+3)th gate lines respectively and mode switching circuits connected to the driving control circuit are added as well. Therefore, when the mode switching circuits receives the first mode control signal, arranging three neighbouring gate lines as a set of gate line along scanning direction and each set of gate line receiving scan signal sequentially along the scanning direction may be realized. The resolution of the display panel is reduced to a third of the resolution, this allows the display panel to reduce power consumption and extend the standby time.

Obviously, those skilled in the art may make any possible changes and modifications without departing from the spirit and essence of the invention. And such changes and modifications are also considered as being within the scope of the invention if they belong to the scope of the claims and equal technology of the invention.

The present application claims priority to Chinese Patent Application No. 201510477072.X filed on Aug. 6, 2015, the contents of which are hereby incorporated by reference in its entirety as part of the disclosure of the present application.

The invention claimed is:

1. A shift register, comprising: an input unit, a reset unit, a node control unit, a pull-up unit, a pull-down unit, an input signal terminal, a reset signal terminal, a first clock signal terminal and a reference signal terminal; wherein an output terminal of the input unit, an output terminal of the reset unit, a first terminal of the node control unit and a control terminal of the pull-up unit are all connected to a first node, and both a second terminal of the node control unit and a control terminal of the pull-down unit are connected to a second node; both an output terminal of the pull-up unit and an output terminal of the pull-down unit are connected to a driving signal output terminal shifted in the register; the input unit is configured to control the potential of the first node under the control of the input signal terminal, the reset unit is configured to control the potential of the first node under the control of the reset signal terminal, the node control unit is configured to control the potential of the first node and the second node, the pull-up unit is configured to provide signal of a first clock signal terminal for the driving signal output terminal under the control of the first node, and the pull-down unit is configured to provide signal of a reference signal terminal for the driving signal output terminal under the control of the second node; further comprising: a selection output unit and a selection control signal terminal; wherein a first input terminal of the selection output unit is connected to the first node, a second input terminal is connected to the second node, a third input terminal is connected to a selection control signal terminal, and an output terminal is used as selection driving output terminal of the shift register;

and the output terminal of the selection output unit outputs signal that is same as signal of the driving signal output terminal of the shift register when the selection control signal terminal receives selection control signal.

2. The shift register according to claim 1, wherein the selection output unit comprises: a first switching transistor, a second switching transistor, a third switching transistor and a fourth switching transistor; wherein the first switching transistor, the gate thereof is connected to the gate of the second switching transistor and the selection control signal terminal, the source thereof is connected to the first node and the drain thereof is connected to the gate of the third switching transistor;

the second switching transistor, the source thereof is connected to the second node and the drain thereof is connected to the gate of the fourth switching transistor;

the third switching transistor, the source thereof is connected to the first clock signal terminal and the drain thereof is connected to the selection driving output terminal;

the fourth switching transistor, the source thereof is connected to the reference signal terminal and the drain thereof is connected to the selection driving output terminal.

3. The shift register according to claim 2, wherein both the first switching transistor and the second switching transistor are P-type transistor or N-type transistor;

both the third switching transistor and the fourth switching transistor are both P-type transistor or N-type transistor.

4. A gate driving circuit includes a plurality of the shift register according to claim 1 in cascade; wherein except for a shift register at last stage, driving signal output terminal of each of the rest shift register is connected to input signal terminal of its adjacent shift register at a next stage, correspondingly;

signal input terminal of a shift register at the first stage is configured to receive trigger signal;

except for the shift register at the first stage, driving signal output terminal of each of the rest shift register is connected to reset signal terminal of its adjacent shift register at a previous stage, correspondingly;

selection driving output terminal of each of the shift register is connected to a gate line.

5. The gate driving circuit according to claim 4, wherein the selection output unit comprises: a first switching transistor, a second switching transistor, a third switching transistor and a fourth switching transistor; wherein the first switching transistor, the gate thereof is connected to the gate of the second switching transistor and the selection control signal terminal, the source thereof is connected to the first node and the drain thereof is connected to the gate of the third switching transistor;

the second switching transistor, the source thereof is connected to the second node and the drain thereof is connected to the gate of the fourth switching transistor;

the third switching transistor, the source thereof is connected to the first clock signal terminal and the drain thereof is connected to the selection driving output terminal;

the fourth switching transistor, the source thereof is connected to the reference signal terminal and the drain thereof is connected to the selection driving output terminal.

6. The gate driving circuit according to claim 5, wherein both the first switching transistor and the second switching transistor are P-type transistor or N-type transistor;

both the third switching transistor and the fourth switching transistor are both P-type transistor or N-type transistor.

7. A display panel comprises: 4N-th gate lines, a first gate driving circuit and a third gate driving circuit located on one side of the display panel, and a second gate driving circuit and a fourth gate driving circuit located on the other side of the display panel; wherein all the first gate driving circuit, the second gate driving circuit, the third gate driving circuit and the fourth gate driving circuit are the gate driving circuit of claim 4;

wherein selection driving output terminals of each of the shift register in the first gate driving circuit are connected to the (4n+1)th gate lines respectively, selection driving output terminals of each of the shift register in the second gate driving circuit are connected to the (4n+2)th gate lines respectively, selection driving output terminals of each of the shift register in the third gate driving circuit are connected to the (4n+3)th gate lines respectively, selection driving output terminals of each of the shift register in the fourth gate driving circuit are connected to the (4n+4)th gate lines respectively, wherein n is an integer larger than and equal to 0 but smaller than N;

the display panel further comprises: a driving control circuit, connected to each of the gate driving circuits, is at least configured to output selection control signal to each of the gate driving circuit, output a first set of time sequence control signal to the first gate driving circuit, outputting a second set of time sequence control signal to the second gate driving circuit, output a third set of time sequence control signal to the third gate driving circuit, and output a fourth set of time sequence control signal to the fourth gate driving circuit; wherein each set of time sequence control signal at least includes trigger signal and clock signal, the width of the trigger signal in each set of time sequence control signal is same, and each of the gate driving circuit is configured to let the driving signal output terminal output scanning signal sequentially under the control of its corresponding set of the received time sequence control signal.

8. The display panel according to claim 7, further comprising: a mode switching circuit connected to the driving control circuit; for each value of m, switching devices that are connected between the (3m+1)th gate line and (3m+2)th gate line, respectively; for each value of m, switching devices that are connected between the (3m+2)th gate line and (3m+3)th gate line, respectively; each of the switching devices is connected to the mode switching circuit; wherein m is an integer larger than and equal to 0; in receiving a first mode control signal, the mode switching circuit is configured to:

control all the switching devices in the ON state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; delay timing of each of signal in the fourth set of time sequence control signal for one-half of the width of the trigger signal than timing of the corresponding signal in the third set of time sequence control signal;

and control the driving control circuit to output the selection control signal towards the selection control signal terminal of the shift register connected to the (3m+1)th gate line, or control the driving control circuit to output the selection control signal towards the selection control signal terminal of the shift register connected to the (3m+2)th gate line, or control the driving control circuit to output the selection control signal towards the selection control signal terminal of the shift register connected to the (3m+3)th gate line.

9. The display panel according to claim 8, wherein, in receiving a second mode control signal, the mode switching circuit is also configured to:

control all the switching devices in the OFF state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; and delay timing of each of signal in the fourth set of time sequence control signal for one-half of the width of the trigger signal than timing of the corresponding signal in the third set of time sequence control signal;

and control all the driving control circuits to output selection control signal towards the selection control signal terminal of all the shift register.

10. The display panel according to claim 9, wherein, in receiving a third mode control signal, the mode switching circuit is also configured to:

control all the switching devices in the OFF state;

make timing of each of signal in the first set of time sequence control signal same as timing of the corresponding signal in the second set of time sequence control signal; make timing of each of signal in the third set of time sequence control signal same as timing of the corresponding signal in the fourth set of time sequence control signal; and delay timing of each of signal in the third set of time sequence control signal for one width of trigger signal than timing of the corresponding signal in the first set of time sequence control signal;

and control all the driving control circuits to output selection control signal towards the selection control signal terminal of all the shift register.

11. The display panel according to claim 10, wherein, in receiving a fourth mode control signal, the mode switching circuit is also configured to:

control all the switching devices in the OFF state;

make timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal;

and control all the driving control circuits to output selection control signal towards the selection control signal terminal of all the shift register.

12. A display device, including the display panel according to claim 7.

13. The display device according to claim 12, further comprising: a mode switching circuit connected to the driving control circuit; for each value of m, switching devices that are connected between the (3m+1)th gate line and (3m+2)th gate line, respectively; for each value of m, switching devices that are connected between the (3m+2)th gate line and (3m+3)th gate line, respectively; each of the switching devices is connected to the mode switching circuit; wherein m is an integer larger than and equal to 0; in receiving a first mode control signal, the mode switching circuit is configured to:

control all the switching devices in the ON state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; delay timing of each of signal in the fourth set of time sequence control signal for one-half of the width of the trigger signal than timing of the corresponding signal in the third set of time sequence control signal;

and control the driving control circuit to output the selection control signal towards the selection control signal terminal of the shift register connected to the (3m+1)th gate line, or control the driving control circuit to output the selection control signal towards the selection control signal terminal of the shift register connected to the (3m+2)th gate line, or control the driving control circuit to output the selection control signal towards the selection control signal terminal of the shift register connected to the (3m+3)th gate line.

14. The display device according to claim 13, wherein, in receiving a second mode control signal, the mode switching circuit is also configured to:

control all the switching devices in the OFF state;

delay timing of each of signal in the second set of time sequence control signal for one-half of the width of the trigger signal than timing of the corresponding signal in the first set of time sequence control signal; delay timing of each of signal in the third set of time sequence control signal for one-half of the width of the trigger signal than timing of the corresponding signal in the second set of time sequence control signal; and delay timing of each of signal in the fourth set of time sequence control signal for one-half of the width of the trigger signal than timing of the corresponding signal in the third set of time sequence control signal;

and control all the driving control circuits to output selection control signal towards the selection control signal terminal of all the shift register.

15. The display device according to claim 14, wherein, in receiving a third mode control signal, the mode switching circuit is also configured to:

control all the switching devices in the OFF state;

make timing of each of signal in the first set of time sequence control signal same as timing of the corresponding signal in the second set of time sequence control signal; make timing of each of signal in the third set of time sequence control signal same as timing of the corresponding signal in the fourth set of time sequence control signal; and delay timing of each of signal in the third set of time sequence control signal for one width of trigger signal than timing of the corresponding signal in the first set of time sequence control signal;

and control all the driving control circuits to output selection control signal towards the selection control signal terminal of all the shift register.

16. The display device according to claim 15, wherein, in receiving a fourth mode control signal, the mode switching circuit is also configured to:

control all the switching devices in the OFF state;

make timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal;

and control all the driving control circuits to output selection control signal towards the selection control signal terminal of all the shift register.

17. A driving method of the display panel according to claim 11, comprising:

in receiving a first mode control signal, the mode switching circuit controls all the switching devices in the ON state; delays timing of each of signal in the second set of time sequence control signal for one-half of the width of the trigger signal than timing of the corresponding signal in the first set of time sequence control signal; delays timing of each of signal in the third set of time sequence control signal for one-half of the width of the trigger signal than timing of the corresponding signal in the second set of time sequence control signal; delays timing of each of signal in the fourth set of time sequence control signal for one-half of the width of the trigger signal than timing of the corresponding signal in the third set of time sequence control signal; and controls the driving control circuits to output selection control signal towards selection control signal terminal of the shift register connected to the (3m+1)th gate line, or controls the driving control circuits to output the selection control signal towards selection control signal terminal of the shift register connected to the (3m+2)th gate line, or controls the driving control circuit to output the selection control signal towards the selection control signal terminal of the shift register connected to the (3m+3)th gate line;

or, in receiving a second mode control signal, the mode switching circuit: controls all the switching devices in the OFF state; delays timing of each of signal in the second set of time sequence control signal for one-half of the width of the trigger signal than timing of the corresponding signal in the first set of time sequence control signal; delays timing of each of signal in the third set of time sequence control signal for one-half of the width of the trigger signal than timing of the corresponding signal in the second set of time sequence control signal; delays timing of each of signal in the fourth set of time sequence control signal for one-half of the width of the trigger signal than timing of the corresponding signal in the third set of time sequence control signal; and controls the driving control circuits to output selection control signal towards the selection control signal terminals of all the shift registers;

or, in receiving a third mode control signal, the mode switching circuit controls all the switching devices in the OFF state; makes timing of each of signal in the first set of time sequence control signal same as timing of the corresponding signal in the second set of time sequence control signal; makes timing of each of signal in the third set of time sequence control signal same as timing of the corresponding signal in the fourth set of time sequence control signal; and delays timing of each of signal in the third set of time sequence control signal for one width of trigger signal than timing of the corresponding signal in the first set of time sequence control signal; and controls the driving control circuits to output selection control signal towards the selection control signal terminals of all the shift registers;

or, in receiving a fourth mode control signal, the mode switching circuit controls all the switching devices in the OFF state; makes timing of each of signal in the first set of time sequence control signal same as timing of the corresponding signal in the second set of time sequence control signal, timing of the corresponding signal in the third set of time sequence control signal, timing of the corresponding signal in the fourth set of time sequence control signal; and controls the driving control circuits to output selection control signal towards the selection control signal terminals of all the shift registers.

* * * * *